US007099618B2

(12) United States Patent
Iwago et al.

(10) Patent No.: US 7,099,618 B2
(45) Date of Patent: Aug. 29, 2006

(54) PAPER DISCHARGE TRAY

(75) Inventors: Toshitaka Iwago, Okazaki (JP); Michifumi Ishigami, Nagoya (JP); Kazuhiro Hoshiya, Nagoya (JP); Shigeharu Katayama, Kakamigamigahara (JP); Takashi Ohama, Iwakura (JP); Ryoichi Matsushima, Kuwana (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/607,129

(22) Filed: Jun. 27, 2003

(65) Prior Publication Data

US 2004/0062579 A1 Apr. 1, 2004

Related U.S. Application Data

(63) Continuation-in-part of application No. 10/396,603, filed on Mar. 26, 2003.

(30) Foreign Application Priority Data

| | | |
|---|---|---|
| Oct. 1, 2002 | (JP) | 2002-26962 |
| Dec. 27, 2002 | (JP) | 2002-379795 |
| Jan. 8, 2003 | (JP) | 2003-000190 |
| Jun. 13, 2003 | (JP) | 2003-016813 |

(51) Int. Cl.
*G03G 15/00* (2006.01)

(52) U.S. Cl. ..... 399/367; 399/369; 399/405

(58) Field of Classification Search ..... 399/405, 399/367, 369, 365, 372, 377; 400/625
See application file for complete search history.

(56) References Cited

U.S. PATENT DOCUMENTS

| | | | | | |
|---|---|---|---|---|---|
| 4,300,248 | A | * | 11/1981 | Dworkin | 4/628 |
| 4,473,220 | A | * | 9/1984 | Hovens et al. | 270/58.08 |
| 4,993,546 | A | * | 2/1991 | Southard | 206/77.1 |

(Continued)

FOREIGN PATENT DOCUMENTS

| | | |
|---|---|---|
| EP | 1 098 505 A2 | 5/2001 |
| JP | 62-153059 | 7/1987 |
| JP | 2-10349 | 1/1990 |
| JP | 5-1755 | 1/1993 |
| JP | 6-10064 | 2/1994 |
| JP | 6-61844 | 9/1994 |
| JP | 7-21467 | 5/1995 |
| JP | A-09-325550 | 12/1997 |
| JP | A-10-157212 | 6/1998 |
| JP | A-10-3013349 | 11/1998 |
| JP | 10-330015 | 12/1998 |
| JP | A-11-43253 | 2/1999 |
| JP | 11-157732 | 6/1999 |
| JP | A-11-255403 | 9/1999 |
| JP | A-2000-122362 | 4/2000 |
| JP | A-2000-131908 | 5/2000 |
| JP | A-2000-155452 | 6/2000 |

(Continued)

*Primary Examiner*—Andrew H. Hirshfeld
*Assistant Examiner*—Dave A. Ghatt
(74) *Attorney, Agent, or Firm*—Oliff & Berridge, PLC

(57) ABSTRACT

A tray and a method thereof that uses the tray including a surface with a first end and a second end opposite to the first end a projection extending away from the surface and from the second end of the surface and a recess formed below the surface and from the projection toward the first end.

18 Claims, 27 Drawing Sheets

U.S. PATENT DOCUMENTS

| | | | | | |
|---|---|---|---|---|---|
| 5,033,728 | A | | 7/1991 | Miura et al. | 271/3.18 |
| 5,111,252 | A | * | 5/1992 | Hamada et al. | 399/393 |
| 5,158,275 | A | * | 10/1992 | Sellers et al. | 271/9.08 |
| 5,175,583 | A | * | 12/1992 | Noh et al. | 399/107 |
| 5,208,612 | A | * | 5/1993 | Obu et al. | 347/152 |
| 5,412,462 | A | | 5/1995 | Matsuo et al. | 399/367 |
| 5,509,529 | A | * | 4/1996 | Kelley | 206/77.1 |
| 5,515,150 | A | * | 5/1996 | Yoshie et al. | 399/367 |
| 5,515,153 | A | * | 5/1996 | Tokunoh | 399/374 |
| 5,839,025 | A | | 11/1998 | Okauchi et al. | |
| 5,975,957 | A | * | 11/1999 | Noda et al. | 439/609 |
| 6,057,936 | A | | 5/2000 | Obara et al. | |
| 6,065,747 | A | * | 5/2000 | Khovaylo et al. | 271/209 |
| 6,231,043 | B1 | * | 5/2001 | James et al. | 271/209 |
| 6,321,063 | B1 | | 11/2001 | Tanaka et al. | |
| D456,834 | S | | 5/2002 | Fetherolf et al. | |
| 6,400,914 | B1 | * | 6/2002 | Noda et al. | 399/90 |
| 6,473,576 | B1 | | 10/2002 | Koshimizu et al. | |
| 6,674,983 | B1 | * | 1/2004 | Enomoto et al. | 399/124 |
| 6,728,511 | B1 | * | 4/2004 | Watanabe | 399/405 |
| 2004/0081495 | A1 | * | 4/2004 | Nakamura | 399/367 |

FOREIGN PATENT DOCUMENTS

| | | | |
|---|---|---|---|
| JP | A-2001-053919 | | 2/2001 |
| JP | A-2001-134030 | | 5/2001 |
| JP | 3205734 | B2 | 6/2001 |
| JP | A-2001-238014 | | 8/2001 |
| JP | A-2001-345566 | | 12/2001 |
| JP | A-2002-6571 | | 1/2002 |
| JP | 2002-62704 | A | 2/2002 |
| JP | 2002-171372 | A | 6/2002 |
| JP | 2002-300369 | A | 10/2002 |
| JP | 2002-362814 | | 12/2002 |

* cited by examiner

E

E

PAPER DISCHARGE TRAY

This is a Continuation-In-Part Application of application Ser. No. 10/396,603 filed Mar. 26, 2003. The entire disclosure of the prior application is hereby incorporated by reference in its entirety.

BACKGROUND OF THE INVENTION

1. Field of Invention

The invention relates to a paper discharge tray. In particular, the invention relates to a paper discharge tray for an image formation apparatus.

2. Description of Related Art

Conventionally, a discharge tray of an image formation apparatus receives a document after an image has been formed on the document or after the document has been read. Such a discharge tray is associated with a facsimile machine, a copier, and a printer, for example.

Discharge trays typically include a recess and/or a stopper in order to accumulate paper and for easy access to the accumulated document. For example, in Japanese Laid-Open Patent Publication 2002-362814, a projection is provided in the middle of the discharge tray with a recess on both sides of the projection. Alternatively, a recess is provided in the middle of the discharge tray with a projection provided on both sides of the recess. In Japanese Laid-Open Utility Model Publication No. 6-61844, for example, the discharge tray includes a recess and a stopper at an end of the recess. The document is ejected over the recess and stopped by the stopper.

SUMMARY OF THE INVENTION

However, in the discharge trays described above, consideration is not given to the variable lengths of different documents. For example, consideration is not given to the difference in lengths between letter size paper and legal size paper. There is thus a need to provide a discharge tray which takes into account the different dimensions of documents which are discharged into the discharge tray in order to allow easy access to the accumulated documents.

The invention thus takes into account the dimensions of various documents and provides a discharge tray which provides adequate support for the documents and allows easy access to the discharged documents.

The invention thus provides, according to a first exemplary aspect of the invention, a tray including a surface with a first end and a second end opposite to the first end, a projection extending away from the surface and from the second end of the surface; and a recess formed below the surface and from the projection toward the first end.

The invention also provides, according to a second exemplary aspect of the invention, a method of scanning documents in an image formation apparatus including the steps of feeding documents to a scanner one by one, scanning the fed document and discharging the scanned document to a discharge tray with a surface with a first end and a second end opposite to the first end, a projection extending away from the surface and from the second end of the surface and a recess formed below the surface and extending from the projection toward the first end.

BRIEF DESCRIPTION OF THE DRAWINGS

Various embodiments of the invention will be described with reference to the drawings wherein.

DETAILED DESCRIPTION OF PREFERRED EMBODIMENTS

Figure 12:
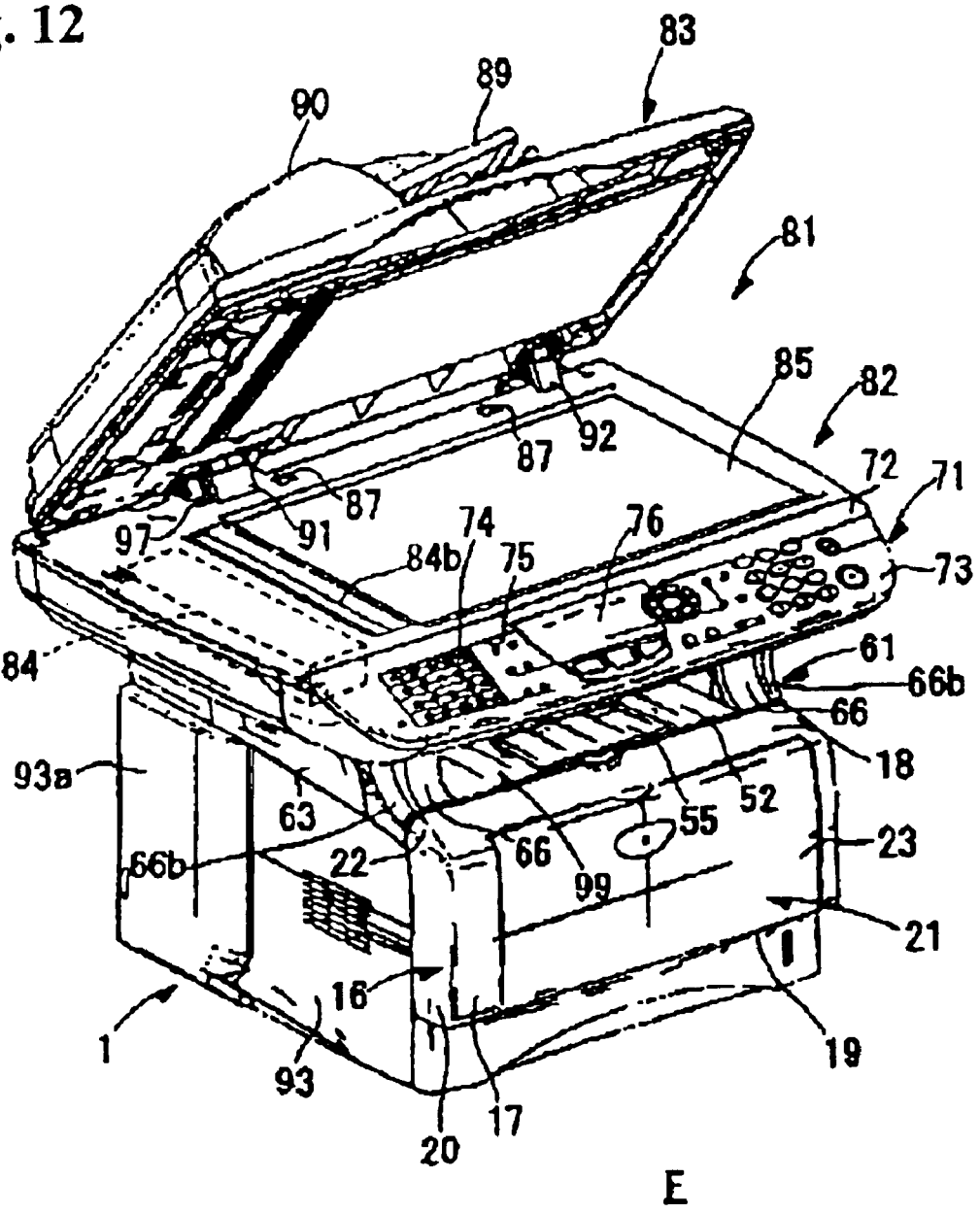
FIG. 12 is a perspective view showing a combined machine of an embodiment of an image formation apparatus of this invention.
Figure 13:
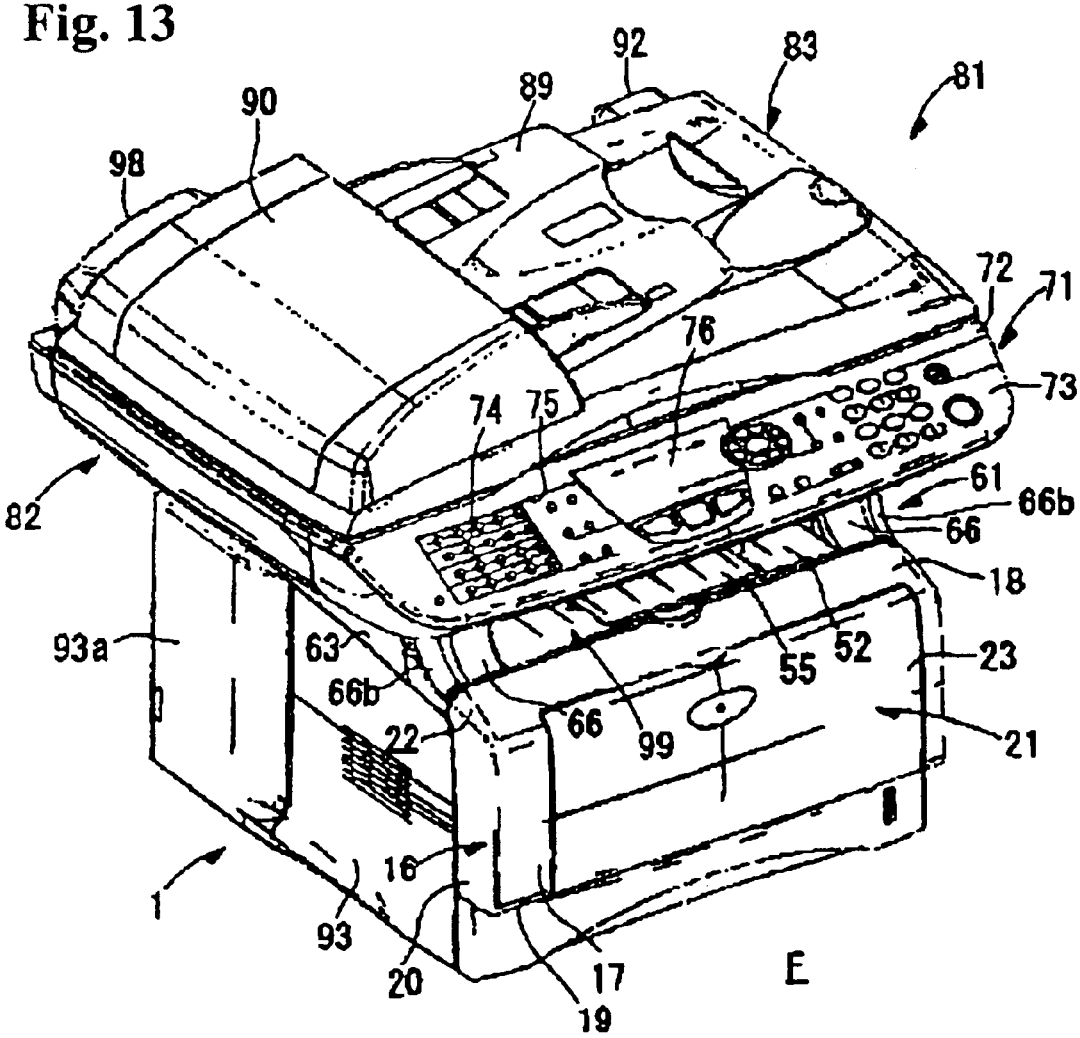
FIG. 13 is a perspective view showing an embodiment of a combined machine as an image formation apparatus of this invention.

FIGS. 12 and 13 are perspective views showing an embodiment of a combined machine F as an image formation apparatus of this invention. In this combined machine F, a flat bed type scanner unit 81 as an image reading unit is mounted on a printer main body 1 as a main body of an image formation apparatus and is provided with a printing function, a copy function, a facsimile function, and a network communication function, for example.

Figure 1:
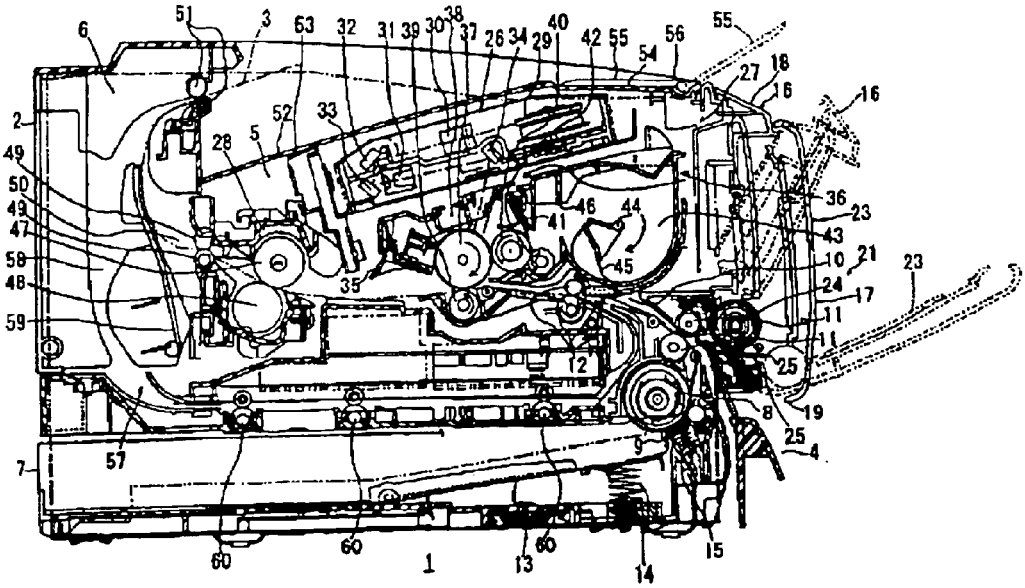
FIG. 1 is a cross-sectional view showing an embodiment of a printer main body.

FIG. 1 is a cross-sectional view showing an embodiment of a printer main body 1. First, the printer main body 1 is explained with reference to FIG. 1. In FIG. 1, the print main body 1 is a laser printer provided with a paper supply portion 4 which supplies paper 3 as a recording medium, an image formation portion 5 which forms an image on the supplied paper 3, an ejecting portion 6 which ejects the paper 3 in which an image has been formed within a resin main body frame 2. Additionally, in the following explanation, a side in which a paper supply roller 8 of the printer main body 1 is arranged is at a front side (front surface side), and a side in which a fixing portion 28, which will be described later, is arranged at a rear side (rear surface side). Furthermore, in a main body frame 2, a left-side frame in which a driving mechanism is mounted is formed of ABS (acrylonitrile butadiene styrene copolymer), and a right-side frame is formed of PS (polystyrene). In particular, the right and left side frames are formed of resin without a reinforcement agent, for example, glass fibers.

A paper supply portion 4 is provided with a paper supply cassette 7, a paper supply roller 8 and a paper supply pad 9 which are upwardly arranged in one end side (front side) end portion of the paper supply cassette 7. The paper is transferred from the paper supply roller 8 to the paper supply path 10, via the paper powder removal roller 11, whenever the reverse side of the paper 3 is exposed. The paper 3 is thereafter transferred via the resist rollers 12.

The paper supply cassette 7 is formed in a box shape of which an upper portion is open. In the bottom portion of the main body frame 2, the paper supply cassette 7 is detachably mounted to the main body frame 2 of the printer main body 1 from the front side. Within this paper supply cassette 7, a paper pressing plate 13 and a spring 14 are arranged. The paper pressing plate 13 stacks the paper 3 in a stacked state. By being movingly supported at an end portion which is distant from the paper supply roller 8, the end portion closer to the paper supply roller 8 can be moved in an up/down direction. Additionally, the spring 14 is arranged so as to apply a force, at a rear surface of the end portion closer to the paper supply roller 8, on the paper pressing plate 13 in an upper direction. Because of this, the paper pressing plate 13 downwardly moves against an urging force of the spring 14 by using an end portion distant from the paper supply roller 8 as a fulcrum as the amount of stacked paper 3 increases.

The paper supply roller 8 and the paper supply pad 9 are arranged in an opposed state, with the paper supply pad 9 pressed toward the paper supply roller 8 by the spring 15 arranged on the rear side of the paper supply pad 9. The uppermost paper 3 on the paper pressing plate 13 is pressed by the spring 14 from the rear side of the paper pressing plate 13 to the paper supply roller 8. After being sandwiched by the paper supply roller 8 and the paper supply pad 9, the paper supply roller 8 is rotated, whereby papers 3 are supplied to the paper supply path 10 as the papers 3 are separated one by one by the paper supply roller 8 and the paper supply pad 9.

Additionally, the supplied paper 3 is arranged above the paper supply roller 8 of the paper supply path 10 and is sent to a resist roller 12 after paper powder is removed by the paper powder removal rollers 11 composed of a pair of rollers. The resist roller 12 is formed of a pair of rollers and transfers the paper 3 to an image formation position (position which contacts a photosensitive drum 37 and a transfer roller 39) after a resist is performed.

Furthermore, the paper supply portion 4 is further provided with a multi-purpose paper supply portion 21 in which paper can be supplied by stacking different sizes of paper 3. That is, in this print main body 1, a front cover 16 is arranged in a front surface of the main body frame 2, and the multi-purpose paper supply portion 21 is arranged in this front cover 16.

Figure 15:
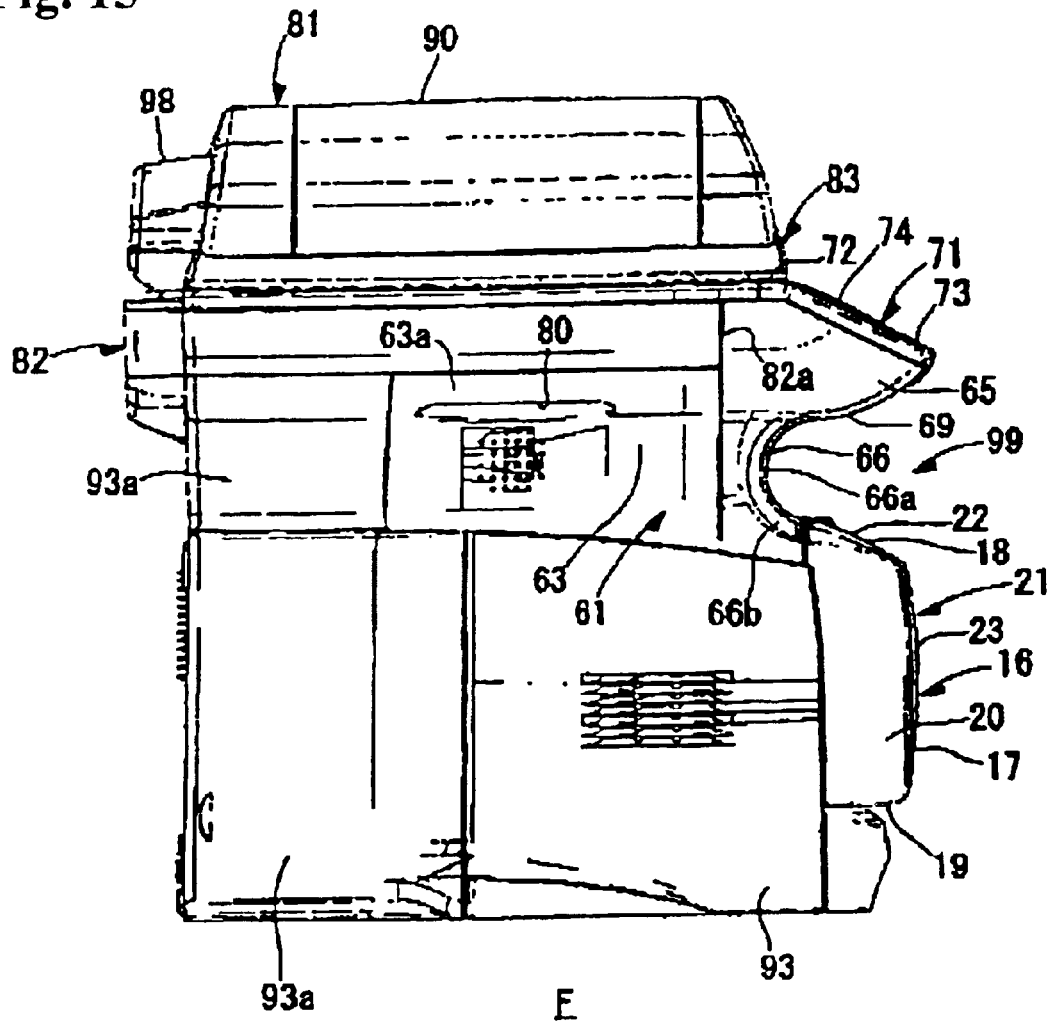
FIG. 15 is a left side view showing the combined machine shown in FIG. 13.
Figure 16:
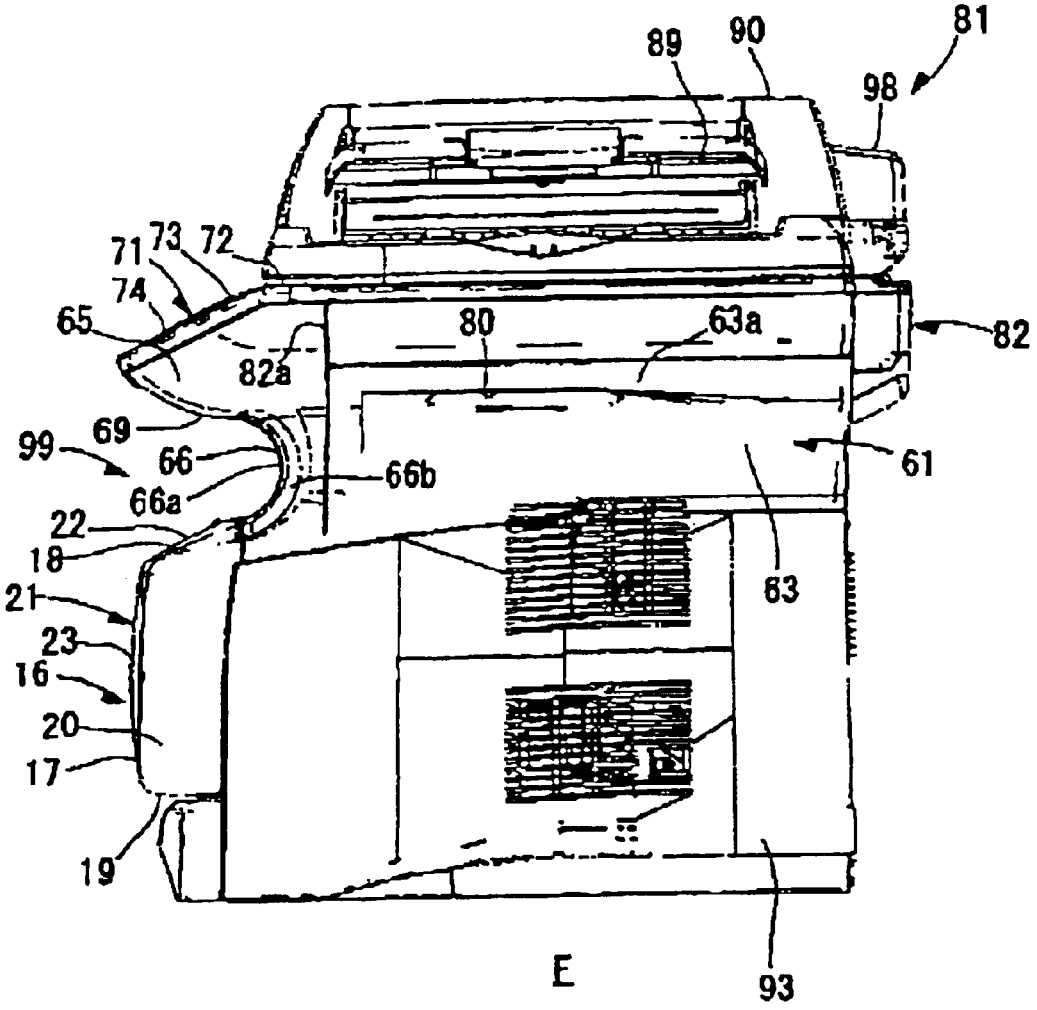
FIG. 16 is a right side view showing the combined machine shown in FIG. 13.

As shown in FIG. 12, the front cover 16 has a shallow box shape in which one side (side facing the front surface of the main body frame 2) is opened. A side surface view is approximately a U shape and a front surface view is approximately a rectangular shape. A front wall 17, as projecting parts of a receiving surface which will be described later, an upper side wall 18, a lower side wall 19 and two side walls 20 are integrally formed. In the front surface of the main body frame 2, this front cover 16 is movably supported by the main body frame 2 via an undepicted hinge arranged in the lower side wall 19. As shown in the imaginary lines of FIG. 1, the front cover 16 is arranged so that, as the upper side wall 18 moves in a front-to-back direction (a paper ejecting direction of the paper 3, hereafter the same), opening and closing can be performed with respect to the main body frame 2. As shown in FIGS. 15 and 16, this front cover 16 projects frontward from a side cover 63 of a joint cover 61 which will be described later. The top surface of the upper side wall 18 is formed in a shape which is downwardly inclined from the rear side to the front side.

Furthermore, the main body side continuation portion 22 is continuous with the front end concave portion 66 of the side cover 63 of the later-described joint cover 61 in the width direction (the direction perpendicular to the paper ejecting direction of the paper 3, hereafter the same). Both end portions of the upper side wall 18 is formed as a shape which is continuous with the front end concave portion 66, without any stepped portions. In the same manner as in the front end concave portion 66, an inclined portion is formed in a curved shape which is inclined rearward at both outer sides.

Additionally, as shown in FIG. 1, the multi-purpose paper supply portion 21 is provided with a multi-purpose tray 23 as a recording medium support device arranged in the front wall 17 of this front cover 16. Within the front cover 16, a multi-purpose side paper supply roller 24 is rotatably supported by the front side lower end portion of the main body frame 2 and a multi-purpose side paper supply pad 25.

As shown in FIG. 12, the multi-purpose tray 23 has a substantially rectangular plate shape in a front view. As shown by imaginary lines of FIG. 1, the multi-purpose tray 23 is rotatably supported by the front wall 17 of the front cover 16 via an undepicted hinge arranged in the lower end portion and can be arranged so as to be opened and closed with respect to the front wall 17 of the front cover 16 as the upper end portion moves in a front-to-back direction.

The multi-purpose side paper supply roller 24 and the multi-purpose side paper supply pad 25 are arranged in a state in which they are opposite each other. The multi-purpose side paper supply pad 25 is pressed toward the multi-purpose side paper supply roller 24 by an undepicted spring arranged on the rear side of the multi-purpose side paper supply pad 25. After the paper 3, stacked on the multi-purpose tray 23 in an expanded state, is sandwiched between the multi-purpose side paper supply pad 25 and the multi-purpose side paper supply roller 24, the multi-purpose side paper supply roller 24 is rotated and the paper 3 is supplied to the paper supply path 10 as it is separated one by one.

The image formation portion 5 is provided with a scanner 26, a processing portion 27, and a fixing portion 28. The scanner 26 is arranged in the upper portion of the main body frame 2 and is provided with a laser light emitter (undepicted), a polygon mirror 29 which is rotatingly driven, lenses 30, 31 and reflecting mirrors 32, 33, 34. As shown by chain lines, a laser beam based on image data whose light is emitted from the laser emitter passes through or is reflected by the polygon mirror 29, the lens 30, the reflecting mirrors 32, 33, the lens 31, and the reflecting mirror 34 in order and is irradiated by high speed scanning onto the surface of a photosensitive drum 37 of the processing portion 27.

The processing portion 27 is arranged in the lower portion of the scanner 26 and is provided with a developing cartridge 36, the photosensitive drum 37, a scorotron type charger 38, and a transfer roller 39 within a drum cartridge 35 which is removably mounted to the main body frame 2. Furthermore, the drum cartridge 35 is detachable from the main body frame 2 as the front cover 16, arranged at the front surface of the main body frame 2, is opened and closed. The developing cartridge 36 is detachably mounted to the drum cartridge 35 and is provided with a developing roller 40, a layer thickness regulating blade 41, a supply roller 42, and a toner hopper 43.

A non-magnetic component of toner with positive charging properties is filled into the toner hopper 43 as a development agent. A polymerization toner is used which can be obtained by copolymerizing a polymerization monomer, for example, a styrene group monomer such as styrene, or an acrylate group monomer such as acrylic acid, alkyl (C1–C4) acrylate, alkyl (C1–C4) metaacrylate, with a known polymerization method such as suspension polymerization or the like. This type of polymerization toner has a substantially round shape with good flowability wherein an image with high image quality can be accomplished. Furthermore, colorant such as carbon black, and wax or the like, are mixed in this type of toner. Additionally, in order to improve flowability, an externally added agent such as silica is added. The powder grain diameter is approximately 6–10 μm.

Additionally, the toner within the toner hopper 43 is agitated by rotation, in an arrow direction (clockwise direction), with an agitator 45 supported by a rotating shaft 44 arranged in the center of the toner hopper 43. Toner is then ejected from a toner supply port 46 which opens on a side portion of the toner hopper 43. At the side position of the toner supply port 46, the supply roller 42 is rotatably arranged and a developing roller 40 is rotatably arranged opposite to this supply roller 42. Additionally, the supply roller 42 contacts the developing roller 40 in a state in which the respective rollers are compressed to some degree. The supply roller 42 is rotatingly driven in an arrow direction (counterclockwise direction). The supply roller 42 is made of conductive foam material covered over a metal roller shaft.

Furthermore, the developing roller 40 is rotatingly driven in an arrow direction (counterclockwise direction). The roller 40 is made of conductive rubber material covered over a metal roller shaft. More specifically, the roller of the developing roller 40 is composed of a coating layer of urethane rubber or silicon rubber containing fluorine covered onto the surface of a roller main body made of conductive urethane rubber or silicone rubber containing carbon micro powder or the like. Furthermore a developing bias is applied to the developing roller 40.

Additionally, the layer thickness regulating blade 41 is arranged in the vicinity of the developing roller 40. This layer thickness regulating blade 41 is provided with a cross-sectional half-round shaped pressing portion made of insulating silicone rubber at the tip end portion of the blade main body made of metal plate spring material the layer thickness regulating blade 41 is supported by the developing cartridge 36 in the vicinity of the developing roller 40, and is constituted such that the pressing portion is pressed against the developing roller 40 by the elasticity of the blade main body.

Additionally, the toner emitted from the toner supply port 46 is supplied to the developing roller 40 by rotating the supply roller 42 and is positively friction charged between the supply roller 42 and the developing roller 40. Furthermore, the toner supplied onto the developing roller 40 enters between the developing roller 40 and the pressing portion of the layer thickness regulating blade 41 according to the rotation of the developing roller 40 and is held on the developing roller 40 as a thin layer with a predetermined thickness.

At the side position of the developing roller 40, the photosensitive drum 37 is rotatably supported in an arrow direction (clockwise direction) in the drum cartridge 35 in a state in which it is opposite to the developing roller 40. This photosensitive drum 37 is formed of a photosensitive layer with a positive charging property, and the drum main body is grounded and the surface is made of polycarbonate or the like. Above the photosensitive drum 37, the scorotron type charger 38 is arranged at a predetermined interval so that it does not contact the photosensitive drum 37. This scorotron type charger 38 is a scorotron charger for positive charging which generates a corona discharge from a charging wire such as tungsten and is constituted such that the surface of the photosensitive drum 37 can be uniformly charged with positive polarity.

A transfer roller 39 is arranged under and opposite to the photosensitive drum 37, and is supported by the drum cartridge 35 so as to be rotatable in an arrow direction (counterclockwise direction). This transfer roller 39 is constituted such that a transfer bias is applied at the time of transfer, and the roller is made of conductive rubber material covered over a metal roller shaft.

As the photosensitive drum 37 is rotated, first the surface of the photosensitive drum 37 is uniformly charged with positive polarity by the scorotron type charger 38, after which it is exposed by a laser beam from the scanner 26, and an electrostatic latent image is formed. After that, as it faces the developing roller 40, a toner, with a positive charge coated on the developing roller 40 due to the developing bias applied to the developing roller 40, is supplied to the electrostatic latent image formed on the surface of the photosensitive drum 37, i.e., to the exposed portion. The photosensitive drum is initially uniformly positively charged, and in which exposure has been performed by a laser beam and the electric potential has been lowered. After that, a toner image coated onto the surface of the photosensitive drum 37 is transferred to the paper 3 by a transfer bias to be applied to the transfer roller 39 when the paper 3 enters between the photosensitive drum 37 and the transfer roller 39.

The fixing portion 28 is to the side of the processing portion 27, and is arranged downstream, in the transfer direction of the paper 3. The fixing portion 28 is provided with a thermal roller 47, a pressing roller 48 which presses the thermal roller 47, and a pair of transfer rollers 49 arranged on the downstream side of the thermal roller 47 and the pressing roller 48. The thermal roller 47 has a metal tube shape and houses a heater formed of a halogen lamp, and is constituted such that it is heated by the heater. Furthermore, the pressing roller 48 presses against this thermal roller 47 and is rotated by the rotation of the thermal roller 47.

Additionally, in the fixing portion 28, the toner is transferred onto the paper 3 in the processing portion 27 and is thermally fixed while the paper 3 enters between the thermal roller 47 and the pressing roller 48. After that, the paper 3 is transferred to the paper ejecting path 50 of the paper ejecting portion 6 by the transfer roller 49. The paper ejecting portion 6 is provided with a paper ejecting path 50, a paper ejecting roller 51 as an ejecting device, and a paper ejecting tray 52 as a receiving surface. The paper ejecting path 50 is a route extended in an up/down direction from the transfer roller 49 to the paper ejecting roller 51 arranged above the transfer roller 49.

The paper ejecting tray 52 has a substantially rectangular plate shape in plan view. The rear end portion is arranged in the middle of the up/down direction between the transfer roller 49 and the paper ejecting roller 51. An inclined plate portion 53 which is upwardly inclined to the front side from the rear end portion is integrally formed so as to be continuous with a flat plate portion 54 which is formed in a flat shape in a substantially horizontal direction from the front end portion of the inclined plate portion 53, and of which the front end portion faces a free end portion of the upper side wall 18 of the front cover 16.

Furthermore, a stopper member 55 which stops the paper 3 to be ejected is arranged in the flat plate portion 54 of the paper ejecting tray 52. That is, in the flat plate portion 54, in a plan view, a substantially rectangular shaped concave portion is formed in the width direction substantially center portion, and the stopper member 55 is arranged in the concave portion. This stopper member 55 has a substantially rectangular plate shape and is rotatably supported with respect to the flat plate portion 54 via a hinge 56 arranged in the front end portion. Furthermore, the stopper member 55 is constituted so as to be opened and closed with respect to the flat plate portion 54 as the rear end portion moves in a front-to-back direction, by using the hinge 56 arranged in the front end portion as a fulcrum. In an expanded state (state shown by imaginary lines of FIG. 1), it is arranged so that an angle of inclination to a front side upper direction becomes larger than the angle of the inclined plate portion 53. Thus, the paper 3 that is ejected is prevented from falling from the front end portion of the paper ejecting tray 52. Furthermore, the paper 3 sent to the paper ejecting path 50 by the transfer roller 49 is sent to the paper ejecting roller 51 and is ejected to the front side (front surface side) from the rear side (rear surface side) onto the paper ejecting tray 52 by the paper ejecting roller 51. Additionally, in the printer main body 1, in order to form an image on both surfaces of the paper 3, a reverse transfer portion 57 as a double-sided printing device is arranged. This reverse transfer portion 57 is provided with a paper ejecting roller 51, a reverse transfer path 58, a flapper 59, and a plurality of reverse transfer rollers 60.

The paper ejecting roller 51 is constituted by a pair of rollers and is constituted such that positive rotation and reverse rotation can be switched. As described above, this paper ejecting roller 51 is rotated in a positive direction when the paper 3 is ejected onto the paper ejecting tray 52, but when the paper 3 is reversed, it is rotated in a reverse direction.

The reverse transfer path 58 is constituted as a route along an up/down direction so that the paper 3 can be transferred from the paper ejecting roller 51 to the plurality of reverse transfer rollers 60 arranged under the image formation portion 5. The upstream side end portion is arranged in the vicinity of the paper ejecting roller 51, and the downstream side end portion is arranged in the vicinity of the reverse transfer roller 60. A flapper 59 is movably arranged so as to face a branch portion of the paper ejecting path 50 and the reverse transfer path 58. Through the excitation or non-excitation of an undepicted solenoid, the transfer direction of the paper 3, reversed by the paper ejecting roller 50, can be switched from a direction facing the paper ejecting path 50 to a direction facing the reverse transfer path 58. Above the paper supply cassette 7, a plurality of reverse transfer rollers 60 are arranged in a substantially horizontal direction. The reverse transfer roller 60 that is farthest upstream is arranged in the vicinity of the rear end portion of the reverse transfer path 58, and the reverse transfer roller 60 that is farthest downstream is arranged under a resist roller 12.

Additionally, when an image is formed on both surfaces of the paper 3, the following shows how this reverse transfer portion 57 is operated. That is, when the paper 3 on which an image has been formed on one surface is sent to the paper ejecting roller 51 from the paper ejecting path 50 by the transfer roller 49. The paper ejecting roller 51 is positively rotated in a state in which the paper 3 is sandwiched. The paper 3 is then temporarily transferred to the paper ejecting tray 52. The positive rotation of the paper ejecting roller 51 is then suspended when most of the paper 3 is sent onto the paper ejecting tray 52 and the rear end of the paper 3 is sandwiched by the paper ejecting roller 51.

Next, the paper ejecting roller 51 is reversely rotated, the flapper 59 changes the transfer direction so that the paper 3 is transferred to the reverse transfer path 58, and the paper 3 is transferred to the reverse transfer path 58 in a front-to-back reverse direction state. Additionally, when the transfer of the paper 3 is completed, the flapper 59 is changed to the original state, i.e., to a state in which the paper 3 sent from the transfer roller 49 is sent to the paper ejecting roller 51.

Next, the paper 3 transferred to the reverse transfer path 58 in a reverse direction is transferred to the reverse transfer roller 60, is reversed to an upward direction from this reverse transfer roller 60, is sent to the paper supply path 10, and is sent to the resist roller 12. The paper 3 transferred to the resist roller 12 is again sent to an image formation position. Thus, an image is formed on both surfaces of the paper 3. Furthermore, in the reverse transfer portion 57 of this printer main body 1, the largest size of the paper 3 on which printing can be performed on both surfaces is set at an A4 size.

Figure 2:
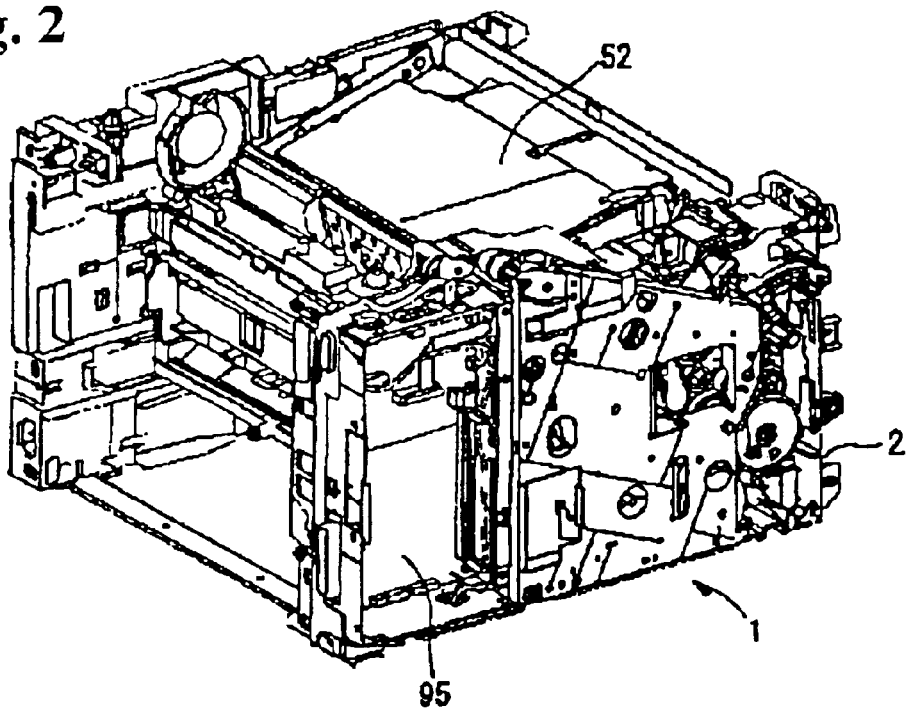
FIG. 2 is a perspective view of a printer main body shown in FIG. 1.

Additionally, as shown in FIG. 2, in the printer main body 1, a main substrate 95, as a circuit board which controls the respective portions of the combined machine F, is arranged on a side surface at the left rear side of the main body frame 2. Furthermore, with respect to the combined machine F, an operation panel unit 71 (see FIG. 12) and the scanner unit 81 (see FIG. 12) are assembled in this printer main body 1.

Figure 3:
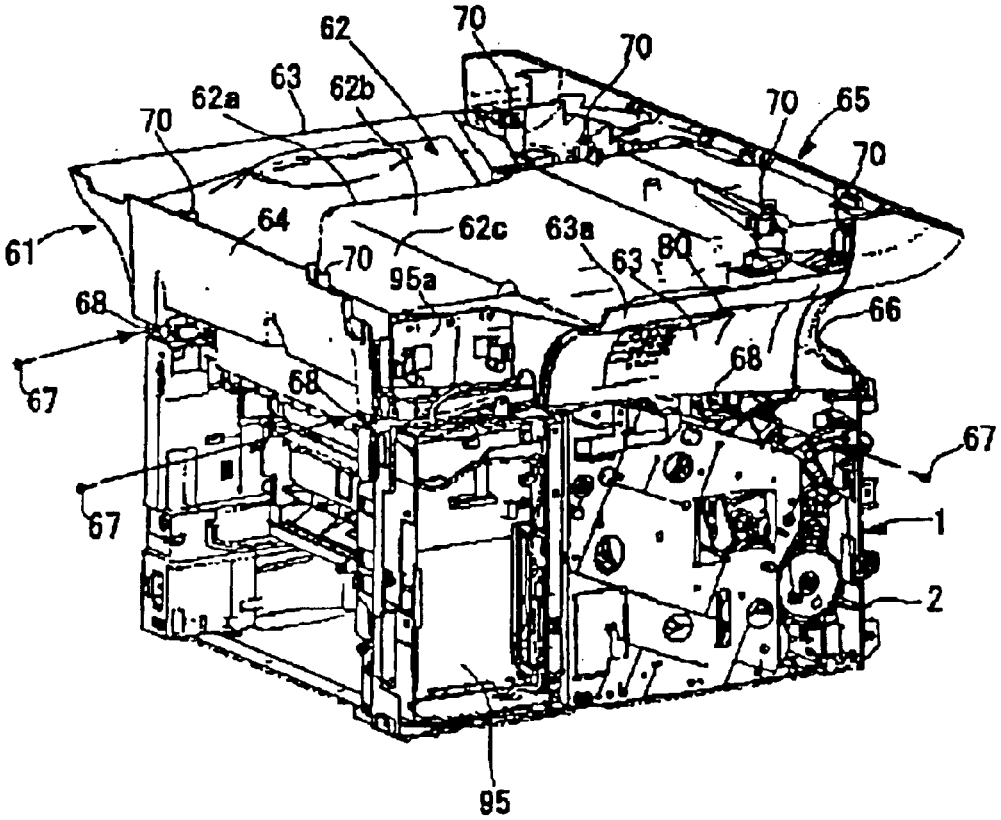
FIG. 3 is a perspective view in which a state where a joint cover is mounted to the printer main body shown in FIG. 1 is seen from a left rear side.
Figure 4:
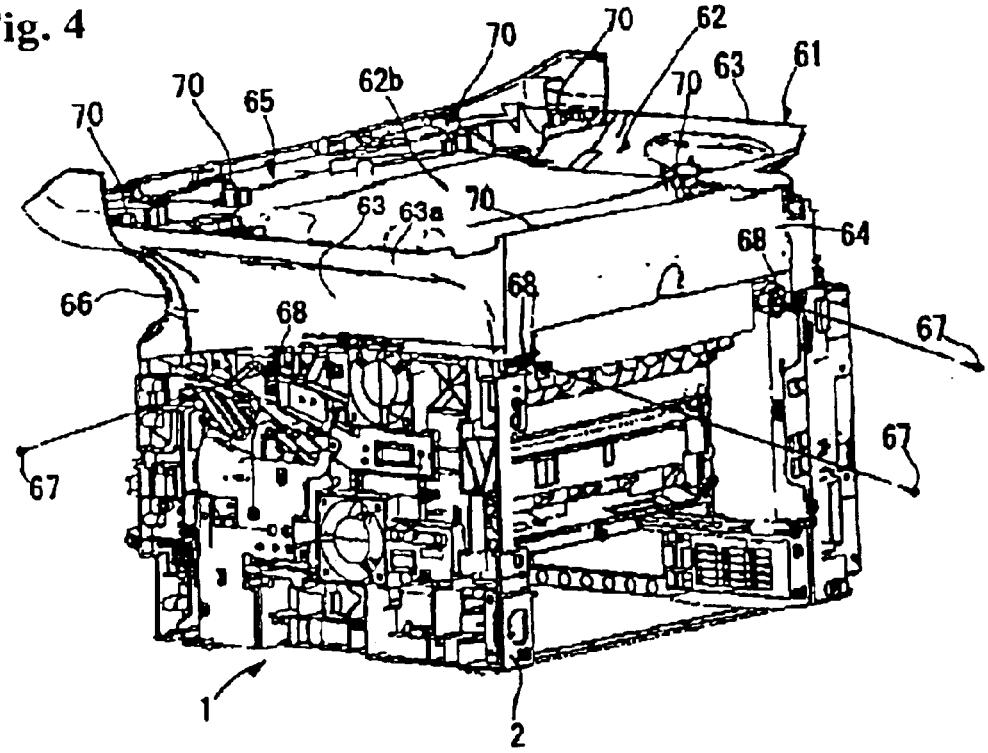
FIG. 4 is a perspective view in which a state where a joint cover is mounted to a printer main body shown in FIG. 1 is seen from a right rear side.

The following explains a method of assembling the combined machine F with reference to FIGS. 2–19. First, in this method, as shown in FIGS. 3 and 4, a joint cover 61, as a support member (an image reading device support member and an operation panel support member), is mounted to the main body frame 2 of the printer main body 1 shown in FIG. 2. The joint cover 61 is molded of PS (polystyrene) resin without a reinforcement agent such as glass fibers. As shown in FIGS. 3 and 4, a scanner unit mounting portion 62 which covers the top portion of the main body frame 2 and in which the scanner unit 81 is mounted, includes side covers 63 as side walls covering both sides of the main body frame 2 in a width direction (right-to-left direction, hereafter the same), a rear cover 64 covering the rear side of the main body frame 2, and an operation panel unit mounting portion 65 which covers the upper front side of the main body frame 2 and in which the operation panel unit 71 is mounted, are integrally molded.

Figure 14:
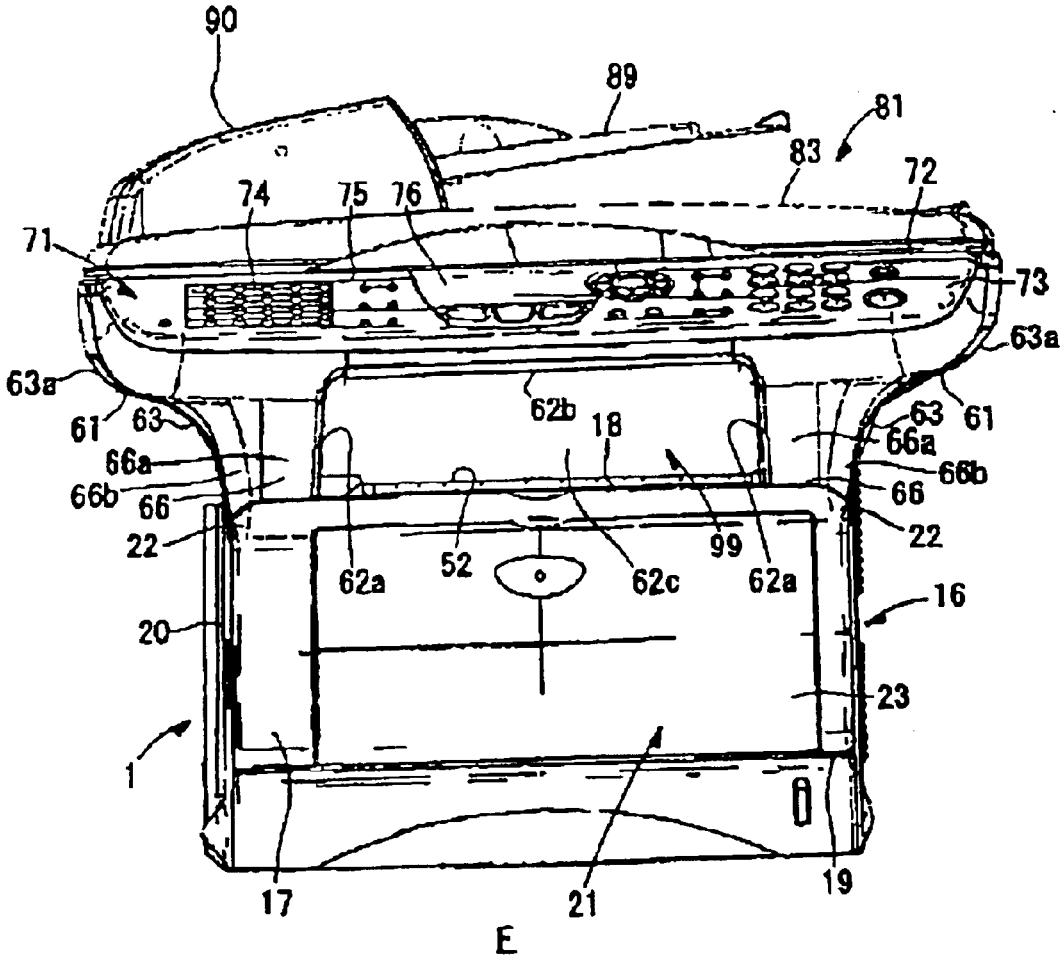
FIG. 14 is a front view showing the combined machine shown in FIG. 13.

As shown in FIG. 14, the scanner unit mounting portion 62, at a position facing the paper ejecting tray 52, includes side walls 62*a*, an upper wall 62*b*, and a back wall 62*c* which are continuously formed. The portion surrounded thereby has a square shape, in front view, in which the lower portion and the front side are opened, and the internal side space makes a paper ejecting space in which the paper 3 in the later-mentioned paper ejecting portion 99 is ejected. Additionally, both side walls 62*a* are formed so as to be continuous with the front side concave portions 66 of the respective side covers 63 which will be described later.

In a state in which the joint covers 61 are mounted to the main body frame 2, the side covers 63 are arranged by sandwiching the paper ejecting tray 52, and the lower end portion is formed as a width which can cover the width direction on both sides of the main body frame 2. Additionally, the side covers 63 are formed substantially in a mushroom shape, expanding from bottom to top, as seen in a frontal view (see FIG. 14), and are curved so as project outward from the both sides of the main body frame 2 in the width direction as they extend from the lower end portion to the upper end portion (in particular, they are sharply curved in the vicinity of the upper end portion), and such that the projecting portions 63*a* of the upper end can receive the scanner unit 81. Furthermore, on the lower surface of the projecting portions 63*a* of the side covers 63, holding portions 80 for lifting the combined machine F are arranged in a groove shape along the front-to-back direction (see FIGS. 15 and 16). By forming the side covers 63 in this type of shape, the holding portions 80 of the projecting portions 63*a* which are projected to the right-to-left direction in the joint covers 61 can be held, and the combined machine F can be lifted and easily carried.

Additionally, the end portion of the front side (the downstream side, in the paper ejecting direction, hereafter the same) of the side covers 63 is curved inward in the width direction, and a front end concave portion 66 is formed as a concave portion which is depressed in a circular arc shape toward the rear side (the upstream side of the paper ejecting direction, hereafter the same) so that its center portion, in the up/down direction, at the front surface becomes the deepest (see FIGS. 15 and 16).

In addition, the deepest portion (i.e., the upstream side end portion, in the paper ejecting direction, of the front end concave portions 66) of the up/down direction center portion which is depressed on the furthest side in the respective front end concave portions 66 is farther forward than the front end portion 82*a* of the document table 82 of the later-described scanner unit 81 (see FIGS. 15 and 16). Also, at the time when printing is performed on both sides of the paper 3 and when an A4 size paper 3 on which an image has been formed on one surface is temporarily sent to the paper ejecting tray 52 by the paper ejecting roller 51, the deepest portion 66*a* is formed so as to be arranged farther forward than the rear end portion (i.e., front end portion in the front-to-back direction in the printer main body 1) M of the sent paper 3 (see FIG. 19).

Figure 19:
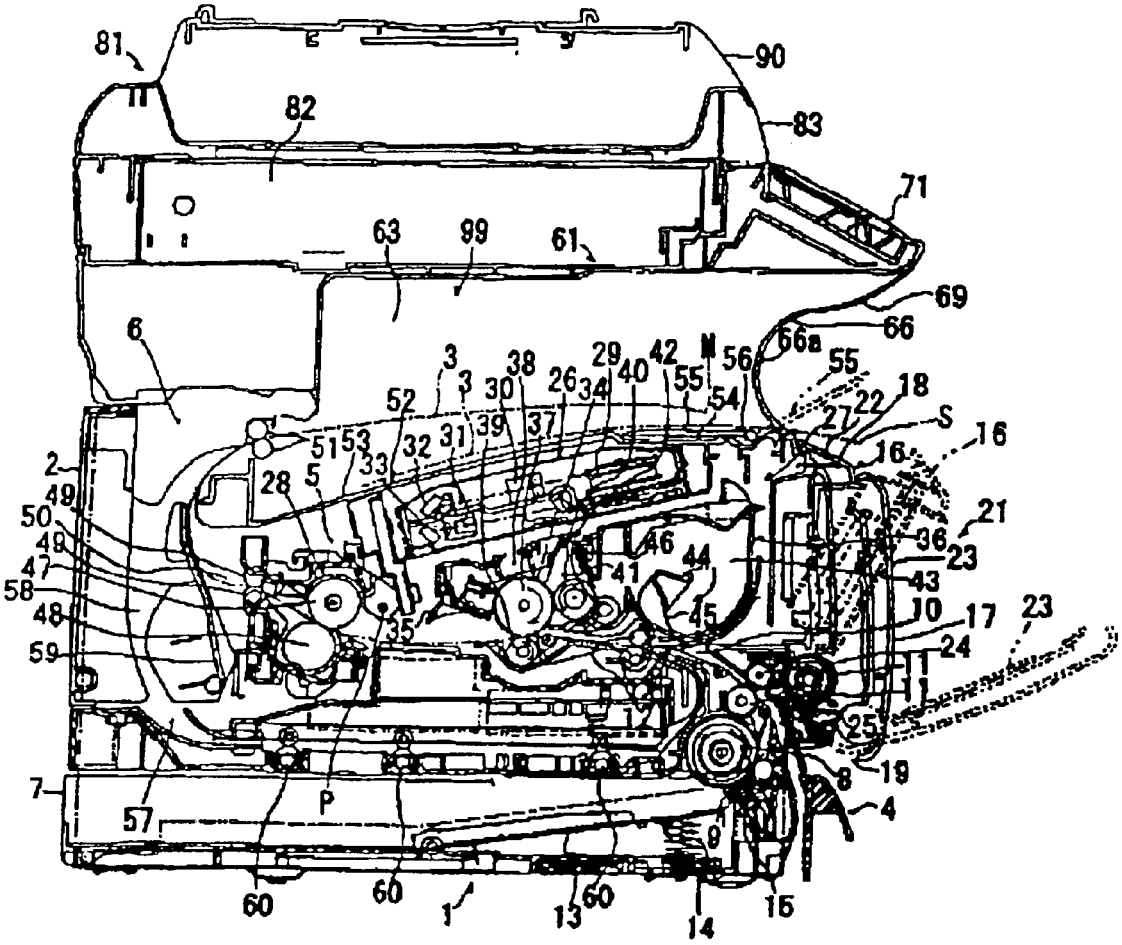
FIG. 19 is a main part side cross-sectional view showing the combined machine shown in FIG. 13.

Furthermore, the respective front end concave portions 66 are formed such that the deepest portion 66*a* of the respective front end concave portions 66 is farther forward than the front end portion of the stopper member 55 (the support side end portion on which the hinge 56 is arranged) in a housed state, and is arranged farther rearward than the rear end portion of the stopper member 55 (the free end portion opposite to the side on which the hinge 56 is arranged) in an open state (see FIG. 19). Furthermore, the respective front end concave portions 66 of the respective side covers 63 are formed as curved inclined surfaces 66*b* in which the outside portion, in the width direction, of the front surface is inclined rearward at both outer sides (see FIG. 14).

Furthermore, as shown in FIGS. 3 and 4, in the middle of the front-to-back direction in the lower end portion of the respective side covers 63, as mounting portions in which tap tight type screws 67 are inserted, resin mounting portions 68 are formed which expand downwardly into a substantially rectangular shape. The rear cover 64 is formed in a rear surface view in a substantially rectangular plate shape. On the width direction, both side end portions of the lower end portion, in the same manner as in the side covers 63, resin mounting portions 68 as mounting portions in which tap tight type screws 67 are inserted are downwardly formed in a substantially rectangular shape.

On the front side of the scanner unit mounting portion 62, the operation panel unit mounting portion 65 is formed so as to project farther forward than the front end concave portions 66 of the side covers 63 (see FIGS. 15 and 16). An operation panel side continuation portion 69 which is continuous with the front end concave portions 66 of the side covers 63 in the operation panel unit mounting portion 65 is formed in a shape which is smoothly continuous with the front end concave portion 66 (see FIGS. 15 and 16).

Furthermore, the upper side of the operation panel unit mounting portion 65 is formed in substantially the same shape as the operation panel unit 71 in a plan view in order to receive the operation panel unit 71. Four screw seating portions 70, which screw the operation panel unit 71, are arranged at a predetermined interval in a width direction at a position facing the rear end portion of the operation panel unit 71.

Furthermore, in this joint cover 61, in the vicinity of the rear cover 64 of the scanner unit mounting portion 62 as well, two screw seating portions 70 which screw the document table 82 of the scanner unit 81 are arranged at a predetermined interval in the width direction. In addition, as shown in FIG. 3, in this joint cover 61, on a side surface of the rear left side, a main substrate 95 of the printer main body 1 and a relay substrate 95*a*, as a circuit board which relays a harness 96 in which the later-mentioned scanning motor 84*a* is electrically connected to the later-mentioned transfer motor 90*a*, are arranged.

Figure 5:
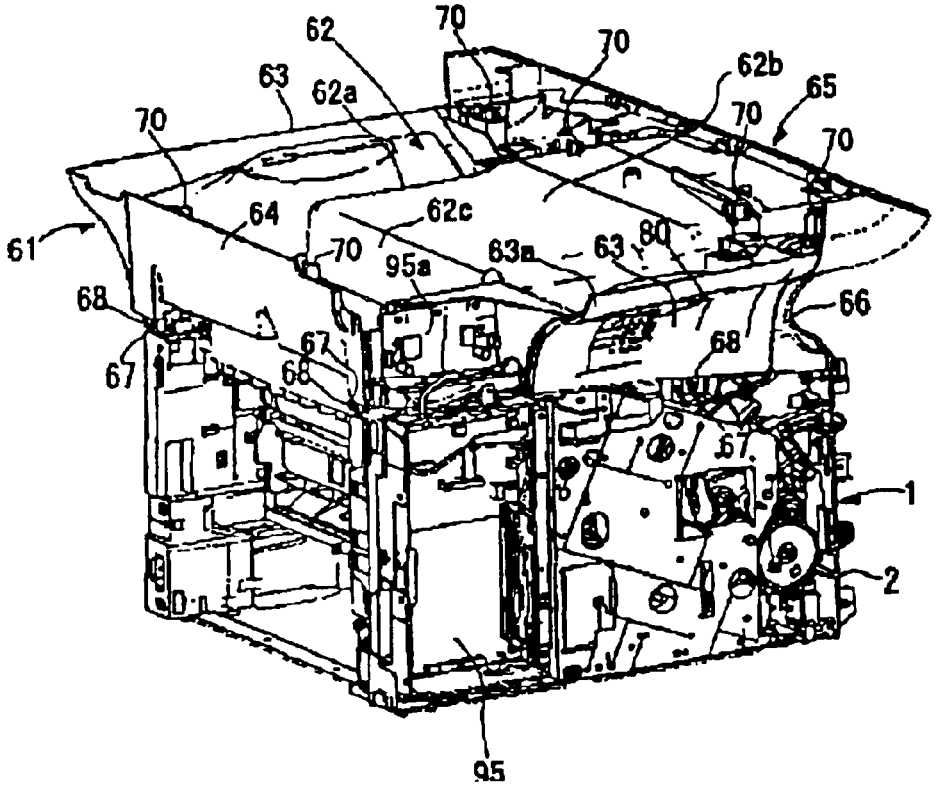
FIG. 5 is a perspective view in which a state where a joint cover is mounted to a printer main body shown in FIG. 1 is seen from a left rear side.

As shown in FIGS. 3 and 4, after this joint cover 61 is mounted on the top portion of the main body frame 2, the tap tight type screws 67 are inserted to the respective fixing portions 68 of the rear cover 64 and the respective side covers 63. The respective screws 67 are engagingly mounted to the resin main body frame 2, and is mounted to the main body frame 2 as shown in FIG. 5. More specifically, the screws 67 which are engagingly mounted via the mounting portions 68 are screwed in and fixed in the resin main body frame 2 while deforming a mounting portion of the main body frame 2 facing the mounting portions 68. Thus, if the mounting portions 68 are fixed to the resin main body frame 2 via the screws 67 and the mounting portions of the joint covers 61 and the printer main body 1 are both resin, thermal expansion and contraction of the respective portions can be made closer to each other, compared to the case in which the mounting portions are resin and metal. Because of this, distortion of the joint covers 61 and the printer main body 1 in the mounting portions can be reduced and the rigidity of the device can be improved.

Figure 6:
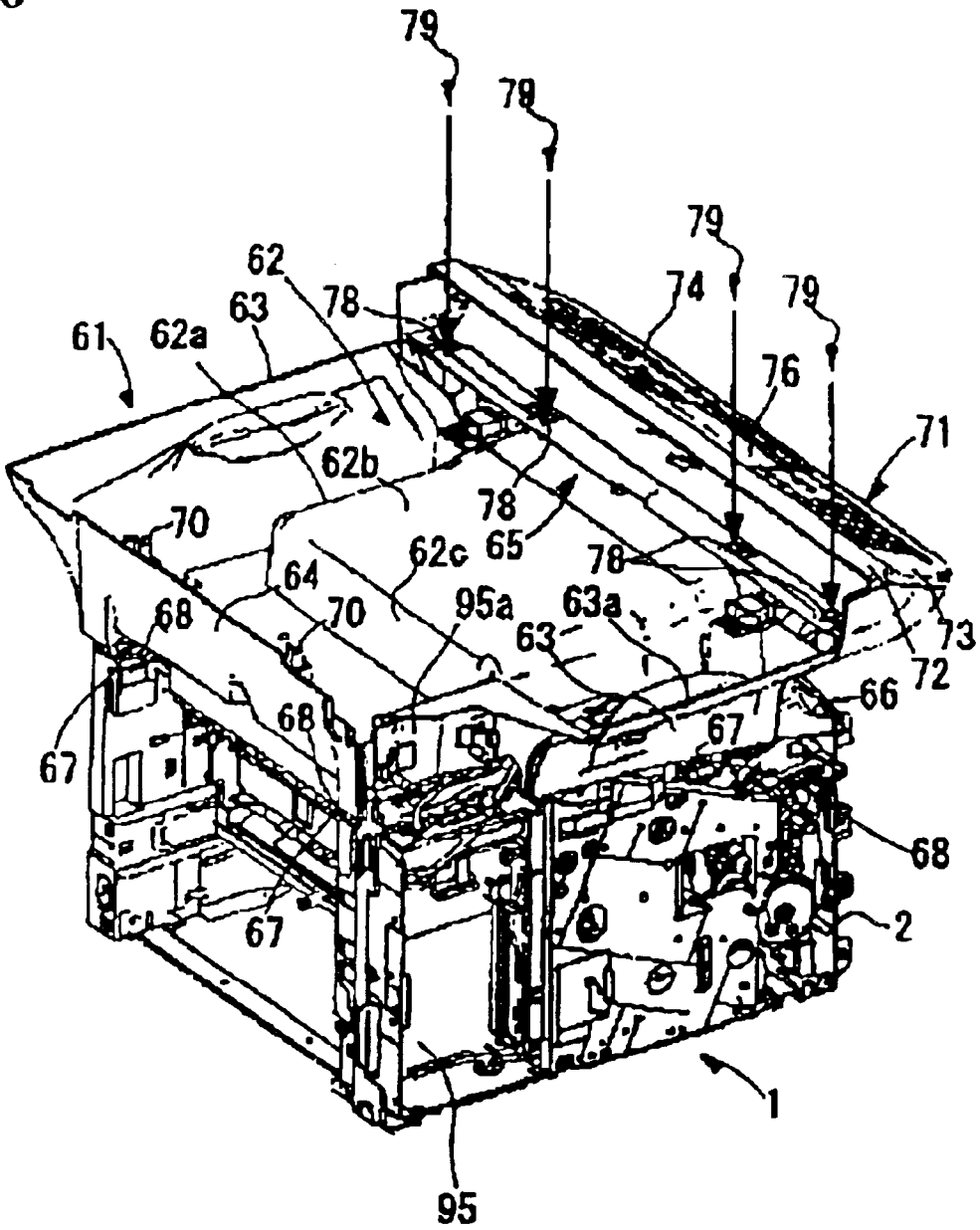
FIG. 6 is a perspective view in which a state where an operation panel unit is mounted to a joint cover shown in FIG. 5 is seen from a left rear side.
Figure 7:
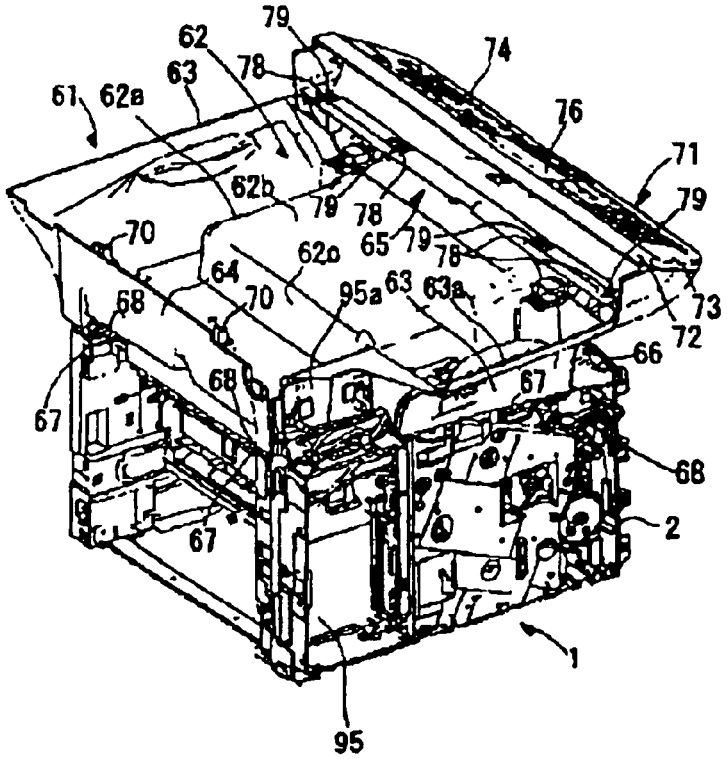
FIG. 7 is a perspective view in which a state where an operation panel unit is mounted to a joint cover shown in FIG. 5 is seen from a left rear side.

Next, in this assembly method, as shown in FIGS. 6 and 7, the operation panel unit 71, as an operation panel, is mounted in the operation panel unit mounting portion 65 of the joint covers 61. The operation panel unit 71 is formed in a substantially oblong rectangular plate shape, in plan view, separate from the scanner unit 81. In a state of being mounted to the joint covers 61, a flat shaped top end panel surface 72 adjacent to a later-mentioned document table 82 on substantially the same plane, and an inclined operation panel surface 73, which is curved and formed in a diagonally downward direction from the front end portion of the top end panel surface 72 opposite a side that is adjacent to the document table 82, are integrated. On the operation panel surface 73, various operation key groups 74 are arranged in which a user operates the printer main body 1 and the scanner unit 81.

Figure 18:
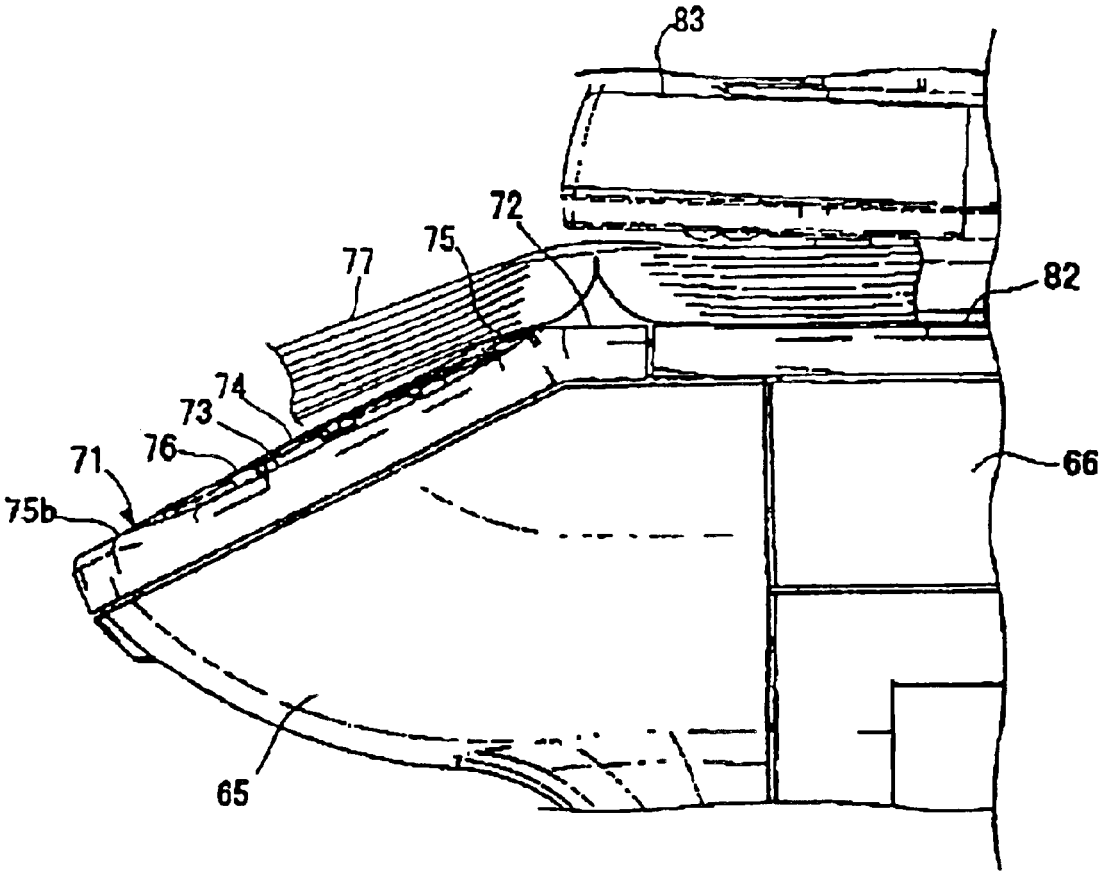
FIG. 18 is a main portion right side view showing an operation panel unit of the combined machine shown in FIG. 13.

Furthermore, in this operation panel unit 71, as shown in FIG. 18 on the document table 82 of the later-described scanning unit 81, if an opened book 77 is placed as a document, an upper restricting projecting portion 75, a lower restricting projecting portion 75*b*, and a cover plate 76 are arranged as accidental pressing restriction portions so that a portion of the book 77 does not press down the operation key groups 74 by mistake. The upper restricting projecting portion 75 is formed by forming the operation panel surface 73 in a moderate projecting shape in the front-to-back direction. The upper restricting projecting portion is also formed such that the top end portion, extending the entire width of the operation panel surface 73 in the right-to-left direction, and which is continuous with the top end panel surface 72, curves so as to project upward at the curved portion of the boundary between the upper end panel surface 72 and the operation panel surface 73.

By so doing, if the opened book 77 is placed on the document table 82, even if part of the book 77 covers the top portion of the operation key groups 74 of the operation panel surface 73, the upper restricting projecting portion 75 can prevent the book 77 from being bent along the curved portion of the boundary between the upper end panel surface 72 and the operation panel surface 73 and can prevent the book 77 from pressing the operation key groups 74. The lower restricting projecting portion 75*b* is formed so that the lower end portion, extending the entire width of the operation panel 73 in the right-to-left direction, projects upward with respect to the operation panel surface 73 at a position farther forward than the operation key groups 74 of the operation panel surface 73. By so doing, if the opened book 77 is placed on the document table 82, as the book 77 contacts the upper restricting projecting portion 75 and the lower restricting projecting portion 75*b*, part of the book 77 can be prevented from pressing the operation key groups 74.

As shown in FIGS. 12 and 18, the cover plate 76 is arranged so as to cover a display portion arranged in the width direction center portion of the operation panel unit 71 and cover the front-to-back direction of the operation panel surface 73 at a predetermined spacing from the operation panel surface 73. This cover plate 76 is formed of a transparent resin plate and is formed so as to be slightly raised from the operation panel surface 73 in a state which covers the operation panel surface 73. By so doing, when the opened book 77 is placed on the document table 82, even if the part of the book 77 covers the top portion of the operation key groups 74 of the operation panel surface 73, the part of the book 77 is placed on this cover plate 76. Thus, the operation key groups 74 can be prevented from being pressed down by the book 77. Therefore, a document such as a book 77 read by the scanner unit 81 can be prevented from pressing the operation key groups 74 by mistake because of the upper restricting projecting portion 75, the lower restricting projecting portion 75*b*, and the cover plate 76, so mis-operation of the device can be prevented.

Furthermore, in this operation panel unit 71, as shown in FIG. 6, the rear end portion is formed at a height at which it can contact the screw seating portion 70 of the joint covers 61. Also, four mounting holes 78 are formed at a predetermined interval in the width direction of the rear end portion. In a state in which this operation panel unit 71 is mounted on the operation panel unit mounting portion 65, by inserting the screws 79 to the respective mounting holes 78 and engagingly mounting the respective screws 79 to the respective screw seating portions 70 arranged in the joint covers 61, as shown in FIG. 7, the operation panel unit 71 is mounted to the joint covers 61.

As shown in FIG. 19, the operation panel unit 71, which is thus mounted, is arranged so as to project farther forward than the printer main body 1. Furthermore, the front end portion of the operation panel unit 71 is positioned on the front side from the free end portion (end portion opposite to the end portion of the side supported by an undepicted hinge) of the multi-purpose tray 23 which is in a housed state within the front cover 16 when the multi-purpose tray 23 is not used. The operation panel unit 71 is also arranged so as to be positioned farther rearward, from the front cover 16, than the free end portion of the multi-purpose tray 23 in an opening state when it is used as shown by imaginary lines.

Figure 8:
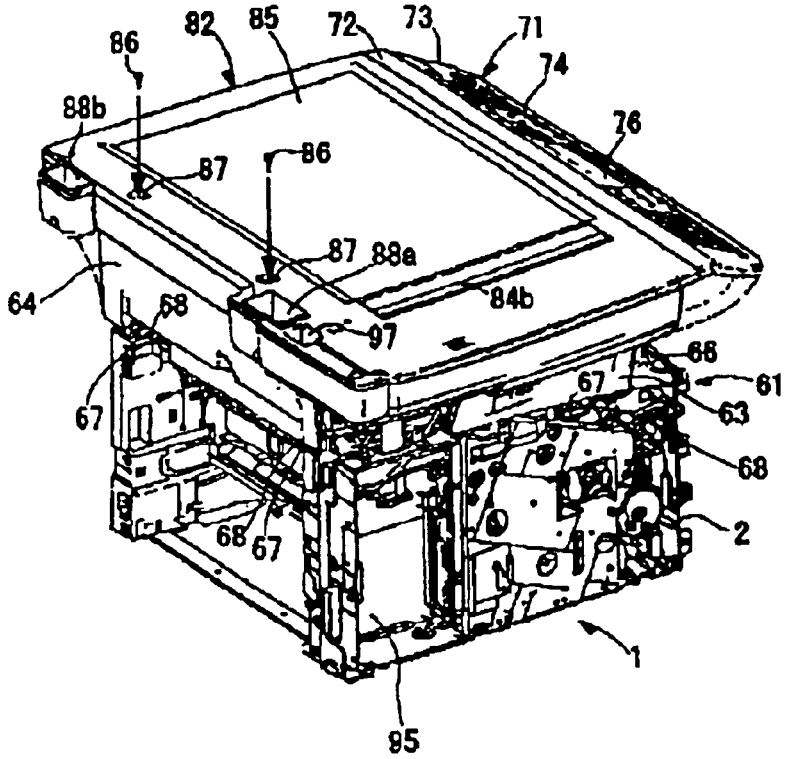
FIG. 8 is a perspective view in which a state where a document table is mounted to a joint cover shown in FIG. 7 is seen from a left rear side.
Figure 17:
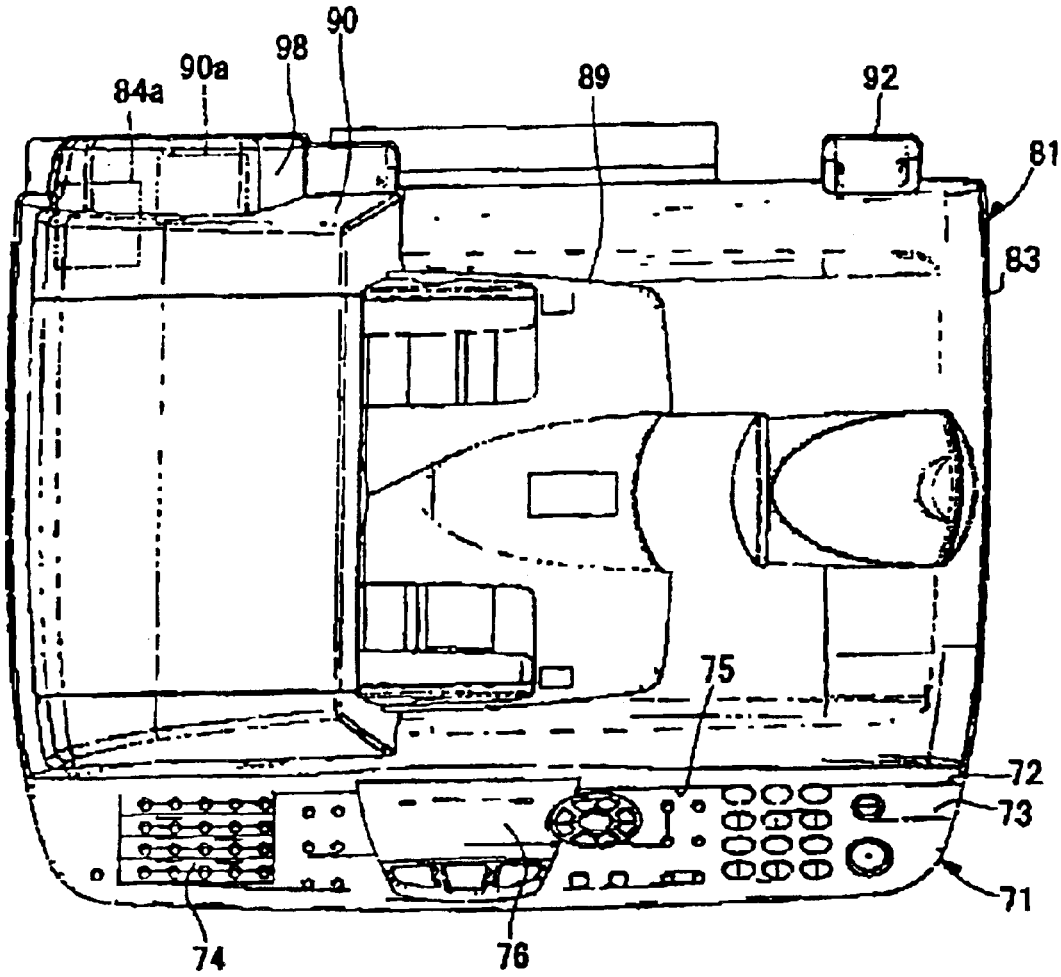
FIG. 17 is a front view showing the combined machine shown in FIG. 13.

Next, as shown in FIGS. 8 and 17, the scanner unit 81 is mounted to the joint covers 61. As shown in FIG. 12, the scanner unit 81 is provided with the document table 82 and a document pressing cover 83 as a document pressing member which is mounted to the document table 82 so as to be openable and closable. The document table 82 is formed in a substantially rectangular thick plate shape. On the top surface, a glass plate 85 is arranged as a substantially rectangular transparent plate on which a document is mounted. A CCD sensor 84 as a document reading device which reads a document and a scanning motor 84*a* (see FIG. 17) as a scanning drive source which scans the CCD sensor 84 in parallel to the glass plate 85 are contained therein. The CCD sensor 84 is usually arranged on the left side from the glass plate 85. The scanning motor 84*a* (see FIG. 17) is in the vicinity of the CCD sensor 84, and more specifically, is housed at the rear left side of this document table 82. The CCD sensor 84 is scanned in the right-to-left direction so as to face the glass plate 85 by the drive of the scanning motor 84*a*.

Furthermore, as shown in FIG. 8, in this document table 82, two through holes 87, through which pass fixing screws 86, are formed in the rear end portion at a predetermined interval in the width direction. Additionally, on this document table 82, a hinge mounting groove 88*a* and a hinge mounting groove 88*b*, in which a later-mentioned main hinge 91 and a subhinge 92 are engaged to mount the document pressing cover 83 in a freely opening/closing state, are provided in the rear end portion at a predetermined interval in the width direction. Furthermore, the hinge mounting groove 88*a* in which the later-mentioned main hinge 91 is inserted is arranged in the rear left side of the document pressing cover 83, in the vicinity of the through hole 87, to the left of and behind the through hole 87.

Furthermore, on this document table 82, to the left of the hinge mounting groove 88*a* in which the later-mentioned main hinge 91 is inserted, as a through hole through which is inserted the harness 96 (see FIG. 11) as a connecting wire which electrically connects the transfer motor 90*a* of the later-mentioned ADF device 90 and the main substrate 95, a connecting opening 97 is formed so as to go through of the document table 82 in the up/down direction.

Figure 9:
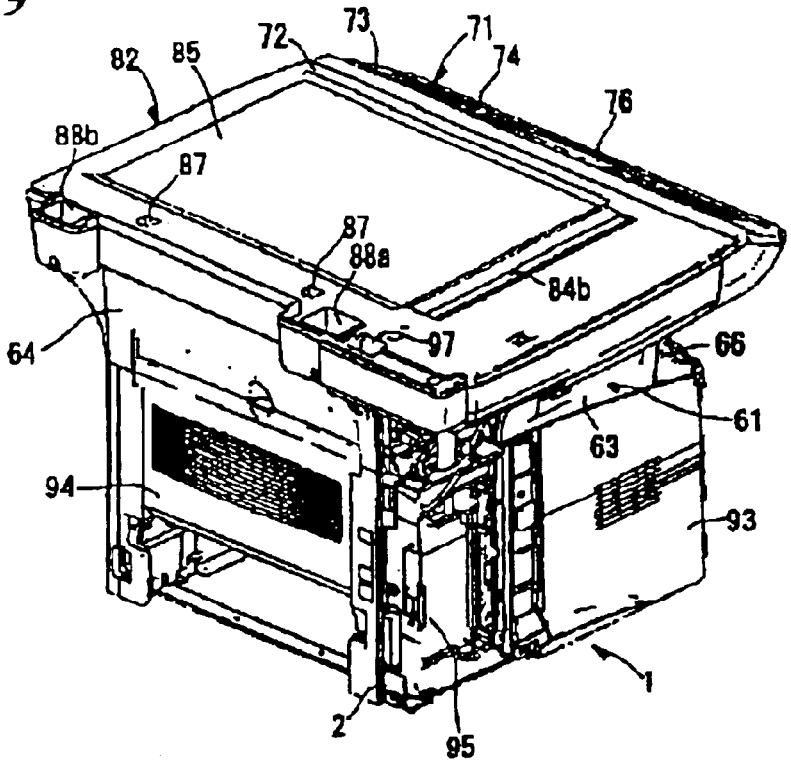
FIG. 9 is a perspective view in which a state where a document table is mounted to a joint cover shown in FIG. 7 is seen from a left rear side.
Figure 10:
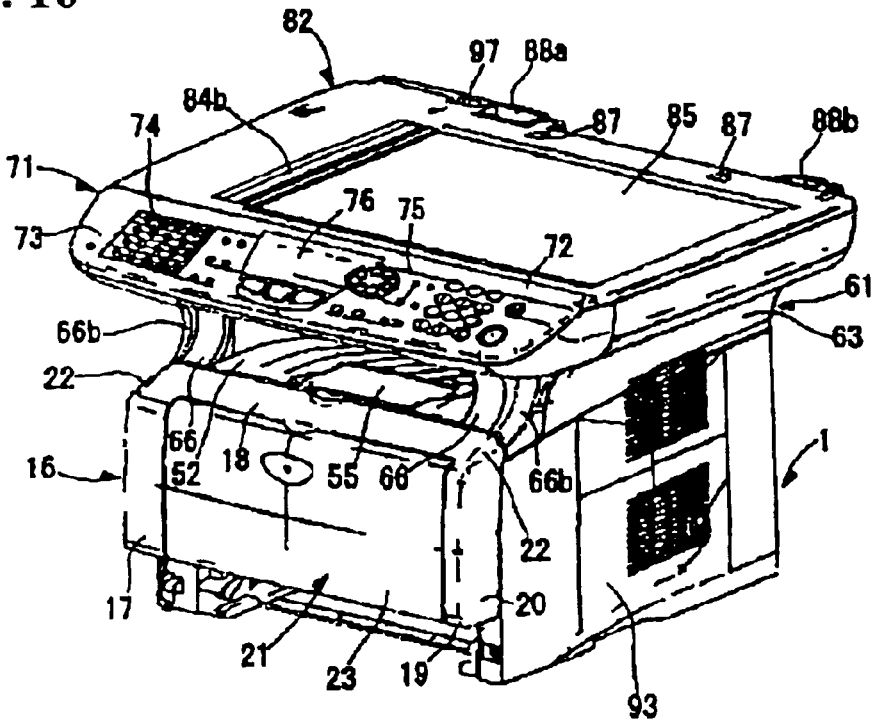
FIG. 10 is a perspective view in which a state where a document table is mounted to the joint cover shown in FIG. 7 is seen from a right front side.

Additionally, as shown in FIG. 8, after the document table 82 is mounted such that the front end portion is overlapped with the rear end portion of the operation panel unit 71 and the rear end portion is placed so that the respective through holes 87 facing the respective screw seating portions 70 of the joint covers 61, the fixing screws 86 are inserted into the respective through holes 87, and the respective fixing screws 86 are engagingly mounted to the respective screw seating portions 70. Thus, the document table 82 is mounted to the joint covers 61 as shown in FIGS. 9 and 10. Furthermore, after the document table 82 is mounted to the joint cover 61, as shown in FIGS. 9 and 10, side cover members 93 are mounted to both sides of the main body frame 2, and a rear cover member 94 is mounted to the rear side of the main body frame 2.

As shown in FIGS. 12 and 13, on the top surface of the document pressing cover 83 are arranged a document setting plate 89, as a document setting member on which stacked documents can be placed, and the ADF (Auto Document Feeder) device 90 as a document feeding device. The ADF (Auto Document Feeder) device 90 is arranged on the rear left side of the document pressing cover 83 and is connected to the document setting plate 89 from the right side. In other embodiments, the ADF device 90 can be placed on the main body 1 separate from the document pressing cover 83. In this ADF device 90 are arranged the transfer motor 90*a* (see FIG. 17) as a document feeding drive source. The transfer motor 90*a* is arranged within a motor cover 98 which is arranged on the rear left side of the document pressing cover 83. Within the ADF device 90 is also arranged an undepicted document detecting sensor. As described next, when the document detecting sensor detects a document to be set to the document setting plate 89, using the pressing down of a scan key as a trigger, the CCD sensor 84 is moved by the drive of the scanning motor 84*a* to an ADF document reading position 84*b* which is located on the left side of the glass plate 85. The document to be set on the document setting plate 89 is then automatically transferred to the ADF document reading position 84*b* by the driver of the transfer motor 90*a*, and the document is read by the CCD sensor 84.

Figure 21:
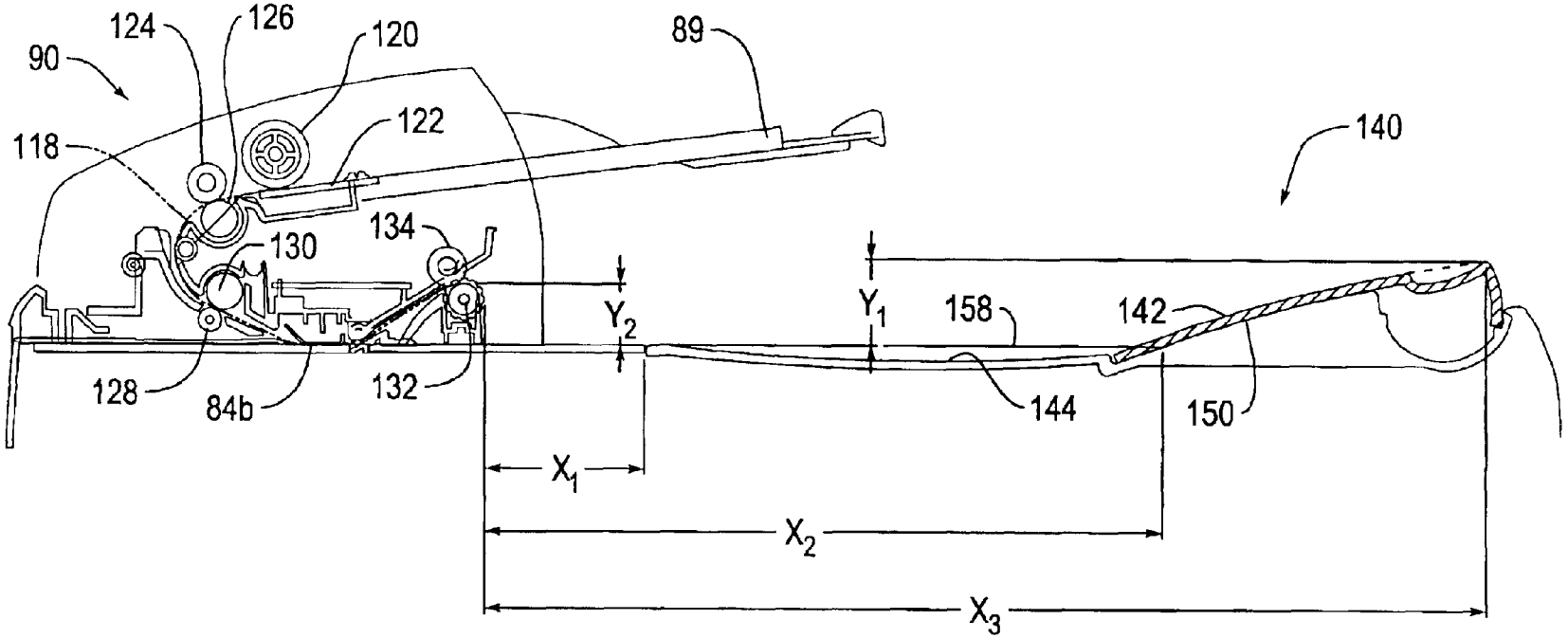
FIG. 21 is a cross-sectional view showing a first embodiment of the automatic document feeder and the discharge tray.

As shown in FIG. 21, the ADF device 90 is provided with a document supply roller 120 rotatably supported at a right end portion of the ADF device 90 and a document supply pad 122. The document supply roller 120 and the document supply pad 122 are arranged in a state in which they are opposite each other. The document supply pad 122 is pressed toward the document supply roller 120 by an undepicted spring arranged on the rear side of the document supply pad 122. After the document, stacked on the document setting plate 89, is sandwiched between the document supply pad 122 and the document supply roller 120, the document supply roller 120 is rotated and the document is supplied to the document supply path 118 as it is separated one by one.

The supplied document is then forwarded to two resist rollers 124–130. Each resist roller is formed of a pair of rollers and transfers the document to the ADF document reading position 84*b*. The document is then transferred to the document ejecting rollers 132, 134 where the document is ejected onto a discharge tray 140 located on the right side of the document pressing cover 83 which will be described later.

Figure 11:
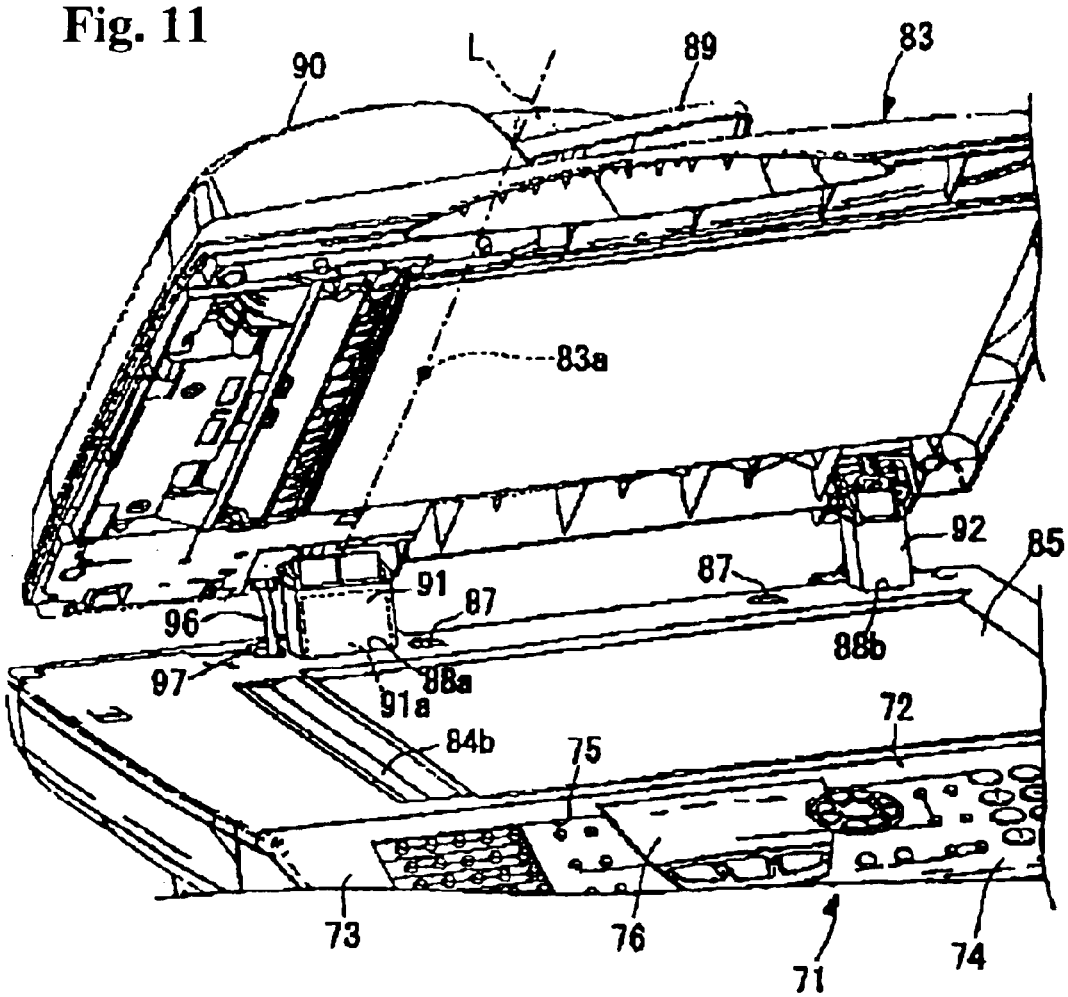
FIG. 11 is an enlarged perspective view in which a state where a document pressing cover is mounted to a document table shown in FIG. 10 is seen from a left front side.

Furthermore, in the document pressing cover 83, as shown in FIG. 11, in the rear end portion, as hinge members for mounting the document pressing cover 83 to the document table 82 in an openable/closable manner, the main hinge 91 and the subhinge 92 are arranged at a predetermined interval in a width direction. With respect to the main hinge 91 and the subhinge 92, the lower end portion is formed in a substantially rectangular thick plate shape which can be engaged to the hinge mounting grooves 88*a*, 88*b* of the document table 82.

The center of gravity of this document pressing cover 83 is on the rear left side of the document pressing cover 83 because of the weight of the ADF device 90. On the rear left side, the main hinge 91 is arranged on a line L that extends in the front-to-rear direction and goes through the center of gravity position of the document pressing cover 83. In this main hinge 91, a torque generation mechanism 91*a*, comprising an undepicted spring, a cam and a slider is housed. The torque generation mechanism 91*a* generates an applied torque in a direction in which the document pressing cover 83 is opened with respect to the document table 82 when the document pressing cover 83 is opened at a predetermined angle or more with respect to the document table 82 (or generates a holding torque in that state).

By arranging this type of torque generation mechanism 91*a*, when the document pressing cover 83 is opened at a predetermined angle or more with respect to the document table 82, the document pressing cover 83 is urged in a direction in which the document pressing cover 83 is opened with respect to the document table 82 (or is held in that state) by the torque generated by the torque generation mechanism 91*a*. Therefore, even if an ADF device 90 with some weight, in which the transfer motor 90*a* or the like is contained, is arranged on the document pressing cover 83, falling of the document pressing cover 83 in a closing direction due to its own weight can be prevented so as not to heavily impact the document table 82.

Furthermore, by arranging the main hinge 91 containing this type of torque generation mechanism 91*a* on the line L that extends into the front-to-rear direction that goes through the center of gravity position of this document pressing cover 83, the document pressing cover 83 can be opened and closed about the line going through the center of gravity position as a rotation fulcrum. Therefore, the other subhinge 92 can be less expensive, without a torque generation mechanism 91*a* or the like, and the reliable opening/closing operation of the document pressing cover 83 can be ensured.

Additionally, as shown in FIG. 11, by inserting the main hinge 91 and the subhinge 92 of the document pressing cover 83 into the respective hinge mounting grooves 88*a* and 88*b* of the document table 82, as shown in FIGS. 12 and 13, the document pressing cover 83 is mounted to the document table 82 so as to be openable and closable. Additionally, as shown in FIG. 11, the transfer motor 90*a* of the ADF device 90 is electrically connected to the main substrate 95 via the relay substrate 95*a* by the harness 96 going through the connecting opening 97 of the document table 82. Additionally, although not depicted, the scanning motor 84*a* which scans the CCD sensor 84 contained in the document table 82 is also electrically connected to the main substrate 95 via the relay substrate 95*a* by a harness that goes through the connecting opening 97 in the middle, in the up/down direction, of the connecting opening 97.

Additionally, after connection is completed by the harness 96 and an undepicted harness, as shown in FIG. 15, a substrate cover member 93*a* is mounted at a position facing the main substrate 95 of the main body frame. Furthermore, in the combined machine F which is thus assembled, above the printer main body 1, the operation panel unit 71 and the scanner unit 81 are supported on the joint covers 61 mounted to the printer main body 1. Also, a coupling portion constituted by the joint covers 61 between the scanner unit 81 and the printer main body 1, including the upper side wall 18 of the front cover 16 and the paper feeding tray 52 of the printer main body 1, is a paper ejecting portion 99 which ejects the paper 3. In this type of paper ejecting portion 99, an internal side space surrounded by the both side walls 62*a*, the upper wall 62*b*, and the rear wall 62*c* in the joint covers 61 is a paper ejecting space in which the paper 3 is ejected, and the upper side wall 18 of the front cover 16 and the paper ejecting tray 52 of the printer main body 1 is a receiving surface which receives the ejected paper 3. Furthermore, in this type of paper ejecting portion 99, the side cover 63 and the rear cover 64 of the joint covers 61 are arranged so as to be also used as an external wall of the paper ejecting portion 99.

Furthermore, in this scanner unit 81, for example, as shown in FIG. 12, after the document pressing cover 83 is opened and a document is placed on the glass plate 85 of the document table 82, if the document pressing cover 83 is closed and a scan key of the operation key groups 74 of the operation panel unit 71 is pressed, the CCD sensor 84 is scanned in the right-to-left direction opposite to the glass plate 85 of the document table 82 by the drive of the scanning motor 84*a*, and an image recorded on the document is thus read by the CCD sensor 84.

Additionally, for example, as shown in FIG. 13, if the document pressing cover 83 is closed, a document is set on the document setting plate 89, and a scan key from the operation key groups 74 of the operation panel unit 71 is pressed. An undepicted document detecting sensor detects the setting of the document to the document setting plate 89, the ADF device 90 automatically transfers documents to the CCD sensor 84 by the drive of the transfer motor 90*a*, the documents successively face the CCD sensor 84 arranged on the left end, and an image recorded on each document is thus read by the CCD sensor 84. Furthermore, the documents read by the CCD sensor 84 are ejected onto the top surface of the document pressing cover 83. Thus, if the CCD sensor 84 and the ADF device 90 are independently driven by the scanning motor 84*a* and the ADF device 90*a*, respectively, a reliable operation according to the document setting position can be ensured.

In particular, in the document pressing cover 83, the document setting plate 89 and the ADF device 90 are arranged, so that a plurality of documents are set in a stacked state in the document setting plate 89, the ADF device 90 automatically transfers the document to the CCD sensor 84 by the drive of the transfer motor 90*a*. Therefore, there is no need for placing a document on the glass plate 84 of the document table 82 one by one, and the document can be effectively read by the CCD sensor 84.

Additionally, in this combined machine F, data of the image read by the CCD sensor 84 is transmitted to the printer main body 1. In the printer main body 1, based on the data, by forming an image on the paper 3, a copying function can be accomplished. Furthermore, in this combined machine F, the joint covers 61 are mounted to the printer main body 1, and the operation panel unit 71 and the scanner unit 81 are mounted to the joint covers 61. Therefore, the operation panel unit 71 and the scanner unit 81 can be reliably assembled to the printer main body 1 via the joint covers 61. Because of this, the printer main body 1, the operation panel unit 71, and the scanner unit 81 are separately constituted, and the respective portions can be replaced independently, or the combination can be changed. Additionally, they can be carried by holding the holding portions 80 of the joint covers 61 because of the reliable assembly.

Furthermore, in this combined machine F, by merely inserting the main hinge 91 and the subhinge 92 into the respective hinge mounting grooves 88*a* and 88*b* of the document table 82, the document pressing cover 83 can be mounted in an openable/closable state, using line L going through the center of gravity position 83*a* of the document pressing cover 83 as a rotation fulcrum, so the opening/closing operation of the document pressing cover 83 can be ensured by the simplified assembly. Furthermore, the line L is a line that goes through the center of gravity position 83*a* and is perpendicular to a center axis of opening/closing of the document pressing cover 83.

Furthermore, in this combined machine F, the main substrate 95 of the printer main body 1, the relay substrate 95*a* of the joint covers 61, the scanning motor 84*a* of the document table 82, and the driving motor 90*a* of the document pressing cover 83 are arranged on the same side, that is, on the rear left side of the combined machine F. Therefore, the length and routing of the harness 96 which electrically connects these can be shortened, the device structure can be simplified, and reliable connection can be ensured between the scanning motor 84*a* and driving motor 90*a* and the relay substrate 95*a* and main substrate 95.

In particular, the driving motor 90*a* of the ADF device 90 is electrically connected to the relay substrate 95*a* and the main substrate 95 via the harness 96, which goes through the connecting opening 97 of the document table 82 formed on the same side as the relay substrate 95*a* and the main substrate 95, that is, on the left rear side of the combined machine F. Therefore, the length and routing of the harness 96 can be further shortened, generation of electrical noise can be reduced, and the reliable connection between the driving motor 90*a*, the relay substrate 95*a*, and the main substrate 95 can be further ensured.

Additionally, in this combined machine F, in the document table 82, the hinge mounting groove 88*a* in which the main hinge 91 is inserted is arranged to the right of the connecting opening 97, that is, the connecting opening 97 is arranged on the same side, the rear left side, of the combined machine F as the main hinge 91 for closing and opening the document pressing cover 83 with respect to the document table 82. Therefore, the harness 96 can be prevented from being contacted and entangled by the document pressing cover 83 that is opened and closed. Because of this, a reliable operation of the device can be ensured.

Furthermore, in this type of assembly method, after the joint covers 61 are mounted to the printer main body 1, the operation panel unit 71 and the scanner unit 81 are mounted to the joint covers 61. Therefore, the printer main body 1, the scanner unit 81, and the operation panel unit 71 are separately constituted. The respective portions can thus be independently replaced, or the combination can be changed. Thus, reliable assembly can be accomplished. Furthermore, in this assembly method, in terms of assembling the scanner unit 81, after the document table 82 is mounted to the joint covers 61, the document pressing cover 83 is mounted to the document table 83, so the reliable assembly of the scanner unit 81 can be accomplished.

In this combined machine F, the front end concave portions 66 of the respective side covers 63 are formed so as to be depressed in a circular arc shape to the rear side. Therefore, the scanner unit 81 is supported by the joint covers 61, and the ejected paper 3 can be easily removed even from the side direction from the depressed portion of the front end concave portions 66. Because of this, rigidity of the apparatus can be ensured, and operability can be improved.

Furthermore, in this combined machine F, as shown by point P of FIG. 19, the center of gravity of the combined machine F is in the vicinity of the rear of the scanner 26 of the printer main body 1. With respect to the center of gravity P, the paper ejecting roller 51 is arranged on the rear side, and the front end concave portions 66 of the side covers 63 are arranged on the front side. Because of this, rigidity is provided to an extent in which the combined machine F can be carried by holding the holding parts 80 of the side covers 63. Because of this, the paper ejecting portion 99 is arranged between the scanner unit 81 and the printer main body 1, and sufficient rigidity can be ensured. Furthermore, in the paper ejecting portion 99, the joint covers 61 are also used as an external wall, so rigidity of the apparatus can be ensured, and the number of parts can be reduced.

In this combined machine F, as shown in FIGS. 15 and 16, the deepest portion 66*a* of the front end concave portion 66 of the respective side covers 63 is arranged farther forward than the front end portion 82*a* of the document table 82 of the scanner unit 81, so in the side covers 63, sufficient rigidity to support the document table 82 can be ensured. Because of this, even if the document table 82 is strongly pressed by hand, damage of the apparatus can be prevented.

In this combined machine F, when both surfaces are printed, by temporarily sending the paper 3 on which an image has been formed on one surface to the paper ejecting portion 99 by the paper ejecting roller 51 of the reverse transfer portion 57, and again retracting it, the front and back of the paper 3 can be reversed. However, in the middle of this type of double-sided printing, when the A4 size paper 3 in which an image has been formed on one surface is temporarily sent onto the paper ejecting tray 52 by the paper ejecting roller 51, the deepest portion 66*a* of the front end concave portions 66 of the respective side covers 63 is arranged farther forward than the rear end portion M of the ejected paper 3 (see FIG. 19). Because of this, the paper 3 is not removed by a user by mistake while an image is not formed on other surface. Because of this, reliable double-sided printing can be ensured, and operability can be improved.

In this combined machine F, as shown in FIGS. 15 and 16, the operation panel unit 71 is arranged so as to be projected to the front side (front surface side) from the printer main body 1. Therefore, the operation panel unit 71 can be arranged closest to the front on the front side at which a user performs operations. Because of this, operability can be improved.

In this combined machine F, as shown in FIG. 19, the front end portion of the operation panel unit 71 is arranged farther forward than the free end portion (the end portion opposite to the end portion of the side supported by an undepicted hinge) of the multi-purpose tray 23, which is in a housed state within the front cover 16 when it is not in use, and as shown by imaginary lines. The front end portion of the operation panel unit 71 is arranged so as to be located farther rearward than the free end portion of the multi-purpose tray 23 in a state of being opened from the front cover 16 when the multi-purpose tray 23 is in use. Because of this, when the multi-purpose tray 23 is in a closed state, that is, when the multi-purpose tray 23 is not in use, the front end portion of the operation panel unit 71 is arranged farther forward than the free end portion of the multi-purpose tray 23, that is, in front of the multi-purpose tray 23 on the front surface side. Additionally, when the multi-purpose tray 23 is in an open state, that is, when the multi-purpose tray 23 is in use, the front end portion of the operation panel unit 71 is arranged farther rearward than the free end portion of the multi-purpose tray 23, that is, the multi-purpose tray 23 is arranged in front of the operation panel unit 71 on the front side. Because of this, when the multi-purpose tray 23 is not used, operability of the operation panel unit 71 can be ensured, and when the multi-purpose tray 23 is used, operability of the multi-purpose tray 23 can be improved.

In this combined machine F, as shown in FIG. 19, with respect to the front end concave portion 66 of the respective side covers 63, the deepest portion 66*a* of the respective front end concave portions 66 is farther forward than the front end portion (the end portion on the support side in which the hinge 56 is arranged) of the stopper member 55 in a housed state, and is arranged farther rearward than the rear end portion (the free end portion opposite to the side in which the hinge 56 is arranged) of the stopper member 55 in an open state. Because of this, when the stopper member 55 is in a closed state, that is, when the stopper member 55 is not in use, the deepest portion 66*a* of the respective front end concave portions 66 is farther forward than the stopper member 55, that is, the deepest portion 66*a* of the respective front end concave portions 66 is arranged in front of the stopper member 55 on the front side. Furthermore, when the stopper member 55 is in an open state, that is, when the stopper member 55 is in use, the deepest portion 66*a* of the respective front end concave portions 66 is arranged farther rearward than the stopper member 55. That is, the stopper member 55 is arranged in front of the deepest portion 66*a* of the respective front end concave portions 66 on the front side. Because of this, rigidity of the apparatus can be ensured, and when the stopper member 55 is used, the paper 3 stacked on the stopper member 55 can be easily removed from the side direction, and operability can be improved.

In this combined machine F, in the paper ejecting portion 99, the top surface of the upper side wall 18 of the front cover 16 are formed in a shape which is downwardly inclined in the direction from the rear side to the front side. Therefore, a space can be formed between a rear end portion S of the paper 3 ejected onto the paper ejecting tray 52 and the top surface of the upper side wall 18. Because of this, the paper 3 can be easily removed by hand from under the rear end portion S.

In this combined machine F, the front end concave portion 66 of the side covers 63 is formed so as to be depressed toward the rear side in a circular arc shape. Furthermore, the operation panel side continuation part 69 which is continuous with the front end concave portions 66 of the side covers 63 in the operation panel unit mounting portion 65 of the joint cover 61 is formed in a shape which is continuous with the front end concave portion 66 without a stepped portion. Furthermore, the main body side continuation portion 22 which is continuous with the front end concave portions 66 of the side covers 63 at both end portions in the width direction of the upper side wall 18 of the front cover 16 is formed as a shape which is continuous with the front end concave portions 66 without a stepped portion. Because of this, when the paper 3 is removed, the paper 3 can be prevented from being caught on the side covers 63 or at the boundary of the operation panel unit 71 side, the printer main body 1 side and the side covers 63. Because of this, the paper 3 can be suitably removed.

In this combined machine F, as shown in FIG. 12, the outer side portions, in the width direction, of the front surface of the front end concave portions 66 of the side covers 63 are formed as curved inclined surfaces 66*b* which are downwardly inclined toward the rear of the outer sides. Therefore, when the paper 3 is removed, the paper 3 can be prevented from being caught on the side covers 63. Furthermore, because of this type of inclined surface, rigidity can be improved.

Figure 20:
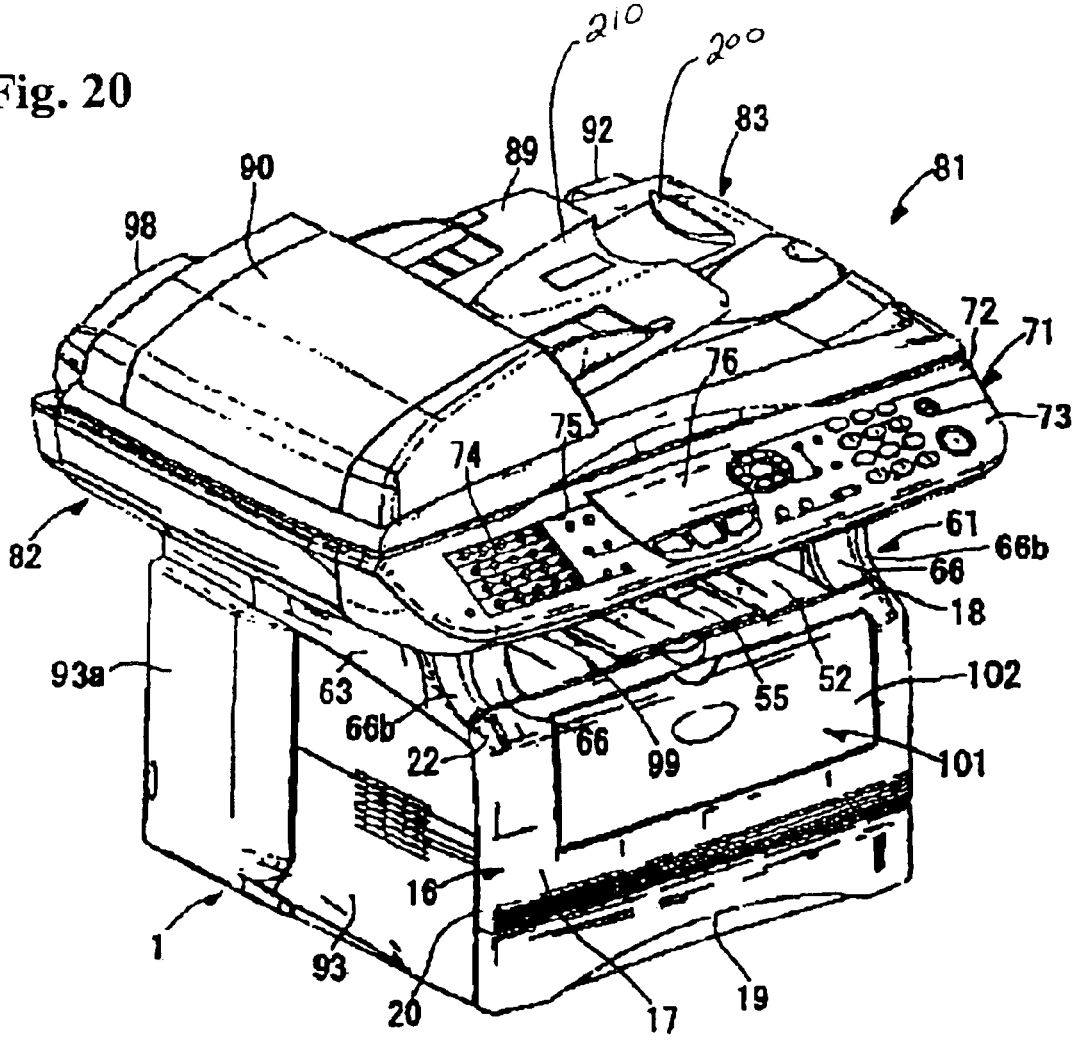
FIG. 20 is a perspective view showing a combined machine of another embodiment as an image formation apparatus of this invention.

In the above-mentioned explanation, in the front surface of the front cover 16 of the printer main body 1, a multi-purpose paper supply portion 21 is provided in which different sizes of paper 3 can be stacked and supplied. However, for example, as shown in FIG. 20, instead of the multi-purpose paper supply 21, a hand inserting portion 101 at which paper 3 is inserted by hand can also be arranged. That is, in FIG. 20, as the hand inserting portion 101, a hand inserting tray 102 can be rotatably arranged as a recording medium support means which can be opened and closed in the front surface of the front cover 16. Furthermore, the multi-purpose paper supply 21 and the hand inserting portion 101 are arranged so as to be opened and closed, but it can be arranged so as to be slidably moved. Furthermore, in the above-mentioned explanation, the document setting member 89 and ADF device 90 are arranged in the document pressing cover 83, but depending on the purpose and usage, there are cases that a document pressing cover 83 is provided without a document setting member 89 or an ADF device 90.

FIGS. 21–24 illustrate the discharge tray 140 incorporated on top of the document pressing cover 83 according to a first embodiment of the invention. The discharge tray 140 includes a projection 142 on the right side of the discharge tray 140 and a recess 144 on the left side of the projection 142.

The projection 142 is supported by the top surface of the discharge tray 140 and is connected to the discharge tray 140 by hinges 146, 148. The projection 142 is thus separate from the discharge tray 140. The projection 142 rotates relative to the discharge tray 140 along an axis of the hinges 146, 148 from a first position (FIG. 23) in which the projection 142 is flat against the discharge tray 140 to a second position (FIG. 24) in which the projection is placed upright and inclined away from the center of the discharge tray 140. While in the second position, a second recess 150 is exposed. The second recess 150 is designed to be slightly larger than the projection 142 so that the projection 142 can fit into the recess 150.

Figure 22:
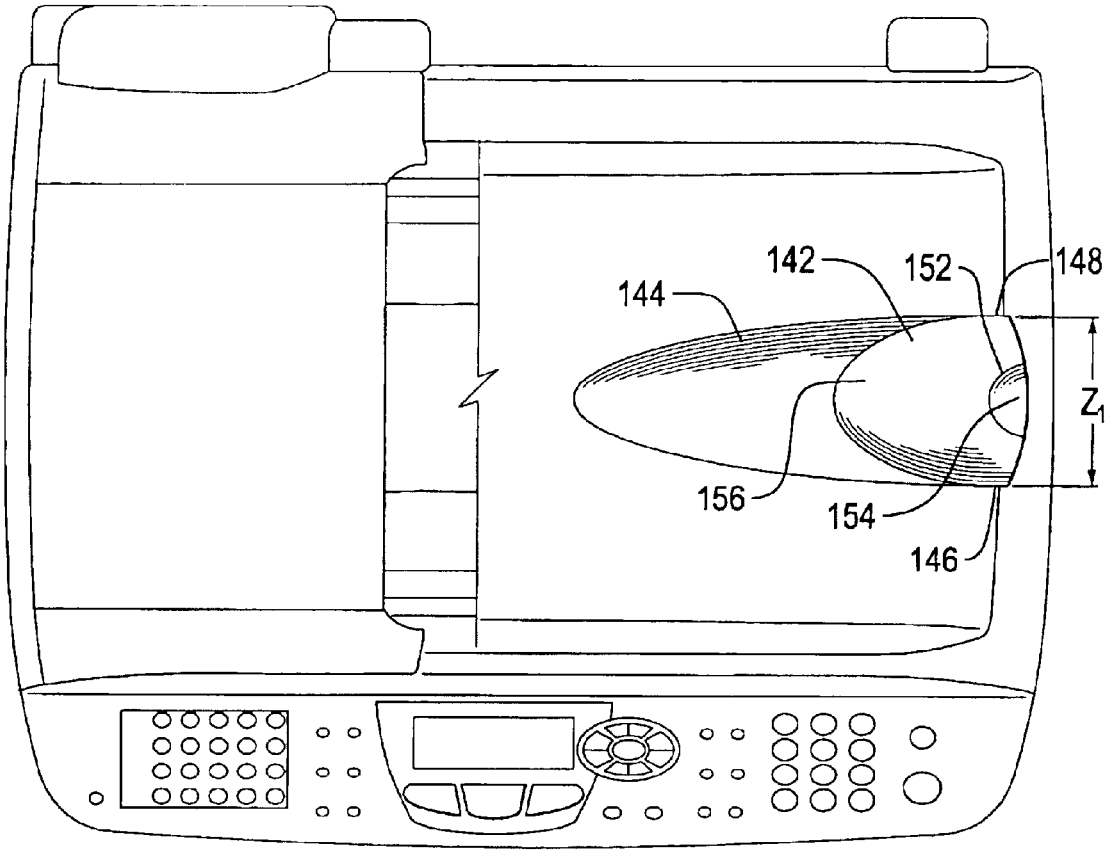
FIG. 22 is a top view showing a first embodiment of the discharge tray.

As shown in FIG. 22, the right side of the discharge tray 140 narrows towards the front side of the discharge tray 140. The hinge 148 is located further inside the discharge tray 140 than the hinge 146. As such the point at which the projection 142 pivots is also shifted along the right side of the discharge tray 140 because of the location of the hinges 146, 148. It is thus easier to operate the discharge tray 140.

When the projection 142 is placed in the first position (FIG. 23), a document that is emitted from the ADF device 90 can be placed over both the recess 144 and the projection 142. While in the second position (FIG. 24), a document that is emitted from the ADF device 90 can be placed over both the recess 144 and the recess 150. Also, when in the second position, the projection 142 has a height which is significantly higher than the point at which a document is ejected from the ADF device 90. Furthermore, the projection is centrally located at the right end of the discharge tray 140. The projection 142 thus acts as a stopper that stops a document ejected from the ADF device 90.

Figure 23:
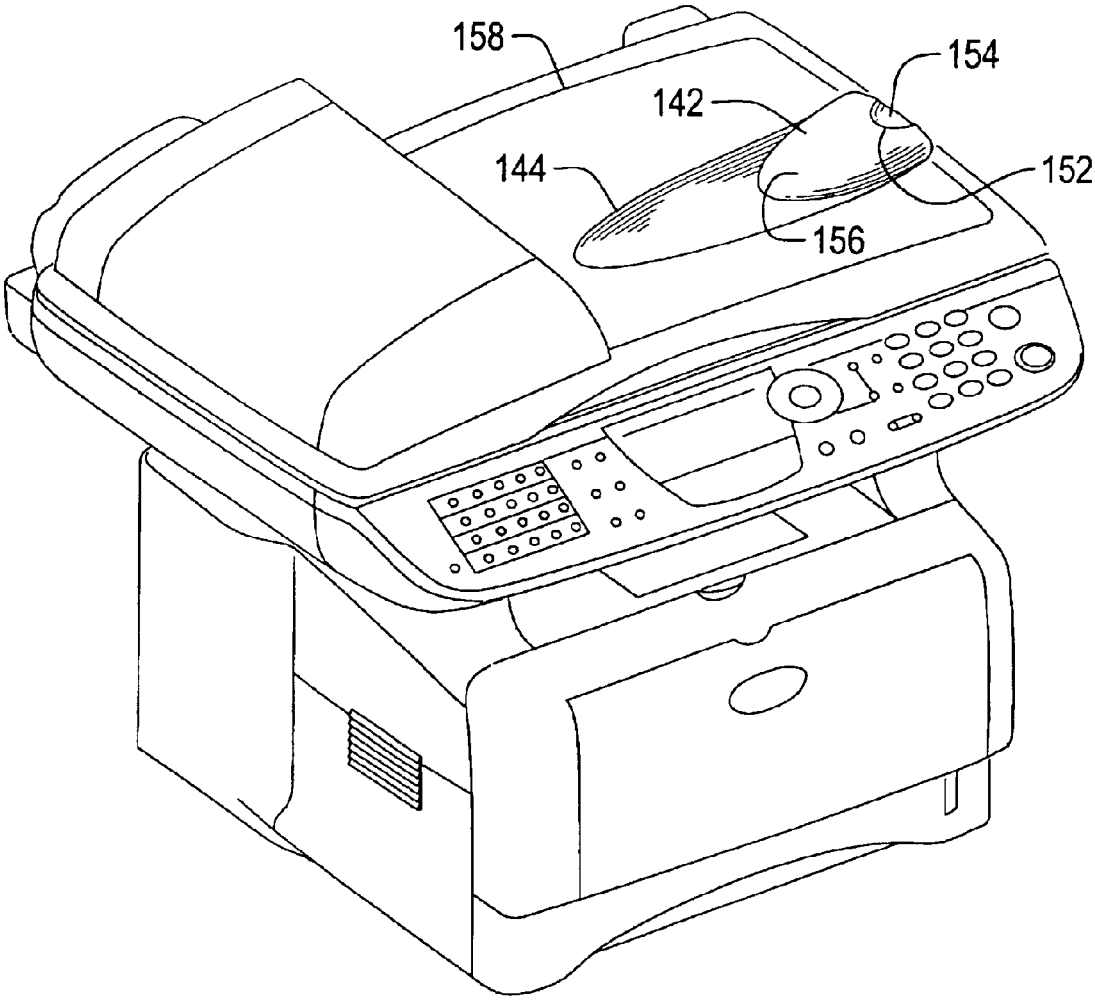
FIG. 23 is a perspective view of the first embodiment of the discharge tray with the projection in the first position.

As shown in FIG. 22, the projection 142 is not symmetrical. In particular, the projection 142 has a width that narrows from the right side of the discharge tray 140 toward the ADF device 90. As should be appreciated, the top side of the projection 142 is wider than the bottom side of the projection 142. Furthermore, as shown in FIG. 23, the projection 142 has two surfaces 154, 156. The first surface 154 starts from the right end of the projection 142 and slopes upwardly toward a crease 152. The second surface 156 starts from the crease 152 and slopes downwardly toward the left end of the projection 142. As such, the handling of documents is simplified because the two surfaces 154, 156 have varying slopes. Also, it is easier to remove discharged documents placed on the projection 142 when the angle between the first surface 154 and the second surface 156 is larger.

As shown, in FIG. 22, the recess 144 is located on the left side of the projection 142 and surrounds the projection 142 from the crease 152 to the left end of the projection 142. The recess 144 is also not symmetrical as the width narrows from the right to the left side of the discharge tray 140.

FIG. 21 illustrates the depths of the projection 142, the recess 144 and the recess 150. As shown in FIG. 21, the projection 142, when in the first position, has a height $Y_1$ that is higher than the point at which the document is ejected from the ADF device 90, $Y_2$. For example, the projection 142 has a height of 25.4 mm that is higher than the height at which the document is ejected from the ADF device 90, 21 mm (these heights are taken from the bottom of the document pressing cover 83). Documents thus remain on the projection 142 because the protection 142 has a height $Y_1$. Furthermore, the height of the projection 142 gradually decreases to the left of the discharge tray 140. As such, a document that is ejected from the ADF device 90 and placed on the projection 142 is moved to the left side of the discharge tray 140 against the ADF device 90. As such, documents can be easily collected as they are positioned against the ADF device 90. This difference in height ($Y_1 > Y_2$) also allows the projection 142 to act as a stopper.

The recess 144 has a depth that gradually decreases from the left side to the right side of discharge tray 140.

Furthermore, the recess 150 has a height that is less than the recess 144 and that gradually increases from the recess 144 to the right side of the discharge tray 140. The difference in height between the recess 144 and the recess 150 allows for the documents to be easily collected.

FIG. 22 illustrates the widths of the projection 142 and the recess 144. As shown in FIG. 22, both the projection 142 and the recess 144 have widths that narrows from the right side of the discharge tray 140 to the ADF device 90. Furthermore, the widths of both the projection 142 and the recess 144 are smaller than the widths of documents commonly ejected from the ADF device 90. As shown in FIG. 22, the maximum width $Z_1$ is at the right end of the projection 112. Hereinafter, when referring to documents commonly ejected, these documents include, for example, letter paper, legal paper, A4 paper, A5 paper and B5 paper. Letter size paper has a width of 215.9 mm and a length of 279.4 mm (215.9×279.4 mm). Similarly, the following papers have the following dimensions: legal-215.9 mm×355.6 mm, A4-210 mm×297 mm, A5-148 mm×210 mm and B5-182 mm×257 mm. For example, the projection 142 has a maximum width of 87.9 mm which is smaller than the width of the documents commonly ejected from the ADF device. The invention is not limited to these documents, but can include other documents.

As such, documents that only land on the recess 144 are supported on the front and rear leading edges by the discharge tray 140. As such, documents can easily be removed because the middle of the document is suspended. Conversely, documents that are placed on the projection 142 are only supported at the middle leading edge of the document. The documents can thus be easily removed because the front and rear leading edges of the document are suspended. However, when the projection 142 is lifted into the second position in order to act as a stopper the recess 150 is exposed. As such, the discharge tray 140 supports the front and rear leading edges of the document with the middle leading edge of the document is suspended similar to recess 142.

FIG. 21 also illustrates the lengths of the projection 142, the recess 144 and the recess 150. As shown in FIGS. 21 and 22, the distance between the point at which the document is ejected from the ADF device 90 and the left end of the recess 144 is indicated as $X_1$. $X_1$ is smaller than the length of the shortest document commonly ejected from the ADF device 90. For example, $X_1$ has a length of 73.5 mm which is less than the lengths of the documents commonly ejected listed above. As such, the leading edge of the shortest document commonly ejected from the ADF 90 overlaps at least a portion of the recess so that the document can be easily removed.

The distance between the point at which the document is ejected from the ADF device 90 to a position on the projection which is on the same horizontal plane as the bottom surface 158 of the discharge tray 140 is indicated as $X_2$. $X_2$ is longer than the length of the shortest document normally ejected from the ADF device 90 but shorter than the longest document normally ejected from the ADF device 90. For example, $X_2$ has a length of 213 mm which is longer than the length of A5 paper that has a length of 210 mm but shorter than the length of legal paper that has a length of 355.6 mm. At least two documents of two different lengths can thus be placed and removed at two different positions on the discharge tray 140.

$X_2$ is also not equal to the length of documents commonly ejected from the ADF device 90. This prevent the edge of the discharged document from corresponding with a leading edge of the projection 142. In other words, the leading and trailing edges of the document are not both supported by the ADF device 90 and the projection 142. Documents are also easier to collect when this length is not the same because the documents can slide toward the ADF device 90. The distance between the point where the document is ejected from the ADF device 90 to a highest point of the projection 142 is indicated as $X_3$.

Figure 24:
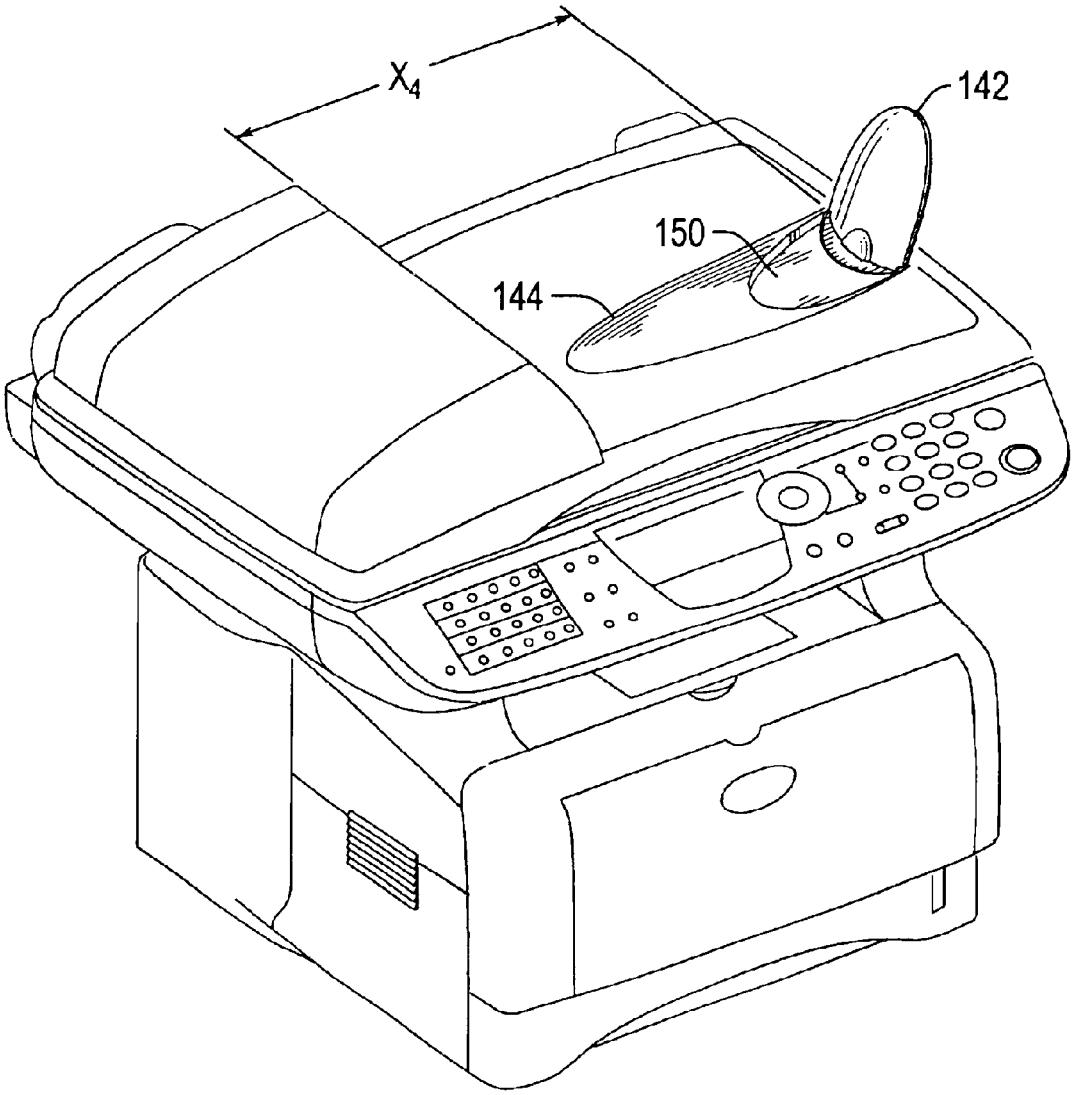
FIG. 24 is a perspective view of the first embodiment of the discharge tray with the projection in the second position.

Finally, as shown in FIG. 24, a distance between the point at which the document is ejected from the ADF device 90 and the left end of the projection 142 when in the second position is indicated as $X_4$. $X_4$ is also not equal to the length of documents commonly ejected from the ADF device 90. When the projection 142 is in the second position, the projection is used as a stopper. Accordingly, documents are not wedged between the ADF device 90 and the projection 142 by having a distance $X_4$ documents thus can be easily removed from the discharge tray 140.

Figure 25:
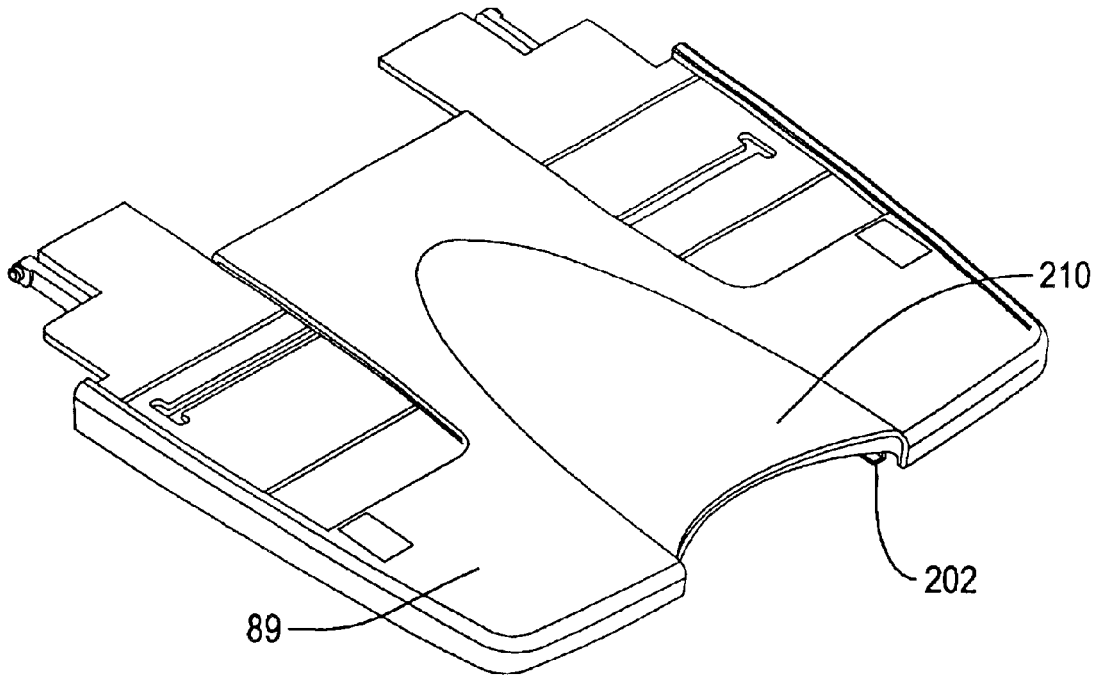
FIG. 25 is a perspective view of the first embodiment of the document setting plate without the projection.

FIGS. 20 and 25 illustrate the document setting plate 89 according to a first embodiment of the invention. The document setting plate 89 is of a substantially rectangular plate and is detachably mounted to the left upper end of the ADF device 90. The document setting plate 89 includes a projection 200 and a recess 210.

The recess 210 extends from a right end of the document setting plate 89 toward the left side of the document setting plate 89. The recess 210 does not have a symmetrical shape. In particular, the width of the recess 210 narrows from right to left. Furthermore, the distance from the point where the document is sandwiched by the separation supply roller 120 and the separation pad 122 to the left end of the recess 210 is shorter than the length of documents commonly used with the ADF device 90. With the dimensions of the recess 210, documents can thus be easily removed, if misplaced for example, by lifting the documents using the recess 210.

The projection 200 is provided on the right side of the document setting plate 89. The projection 200 is attached to document setting plate 89 and is movable from an extended state (FIG. 20) to a contracted stated using guide rails 202 as shown in FIG. 25. A document with a length longer than distance from the point where it is sandwiched by the separation roller 120 and the separation pad 122 to the right end of the recess 210 can be supported at the trailing edge by the projection 200. The trailing edge of the document is only supported at the middle trailing edge of the document. The document can thus be easily removed by grabbing the front and rear trailing edge of the document.

Figure 26:
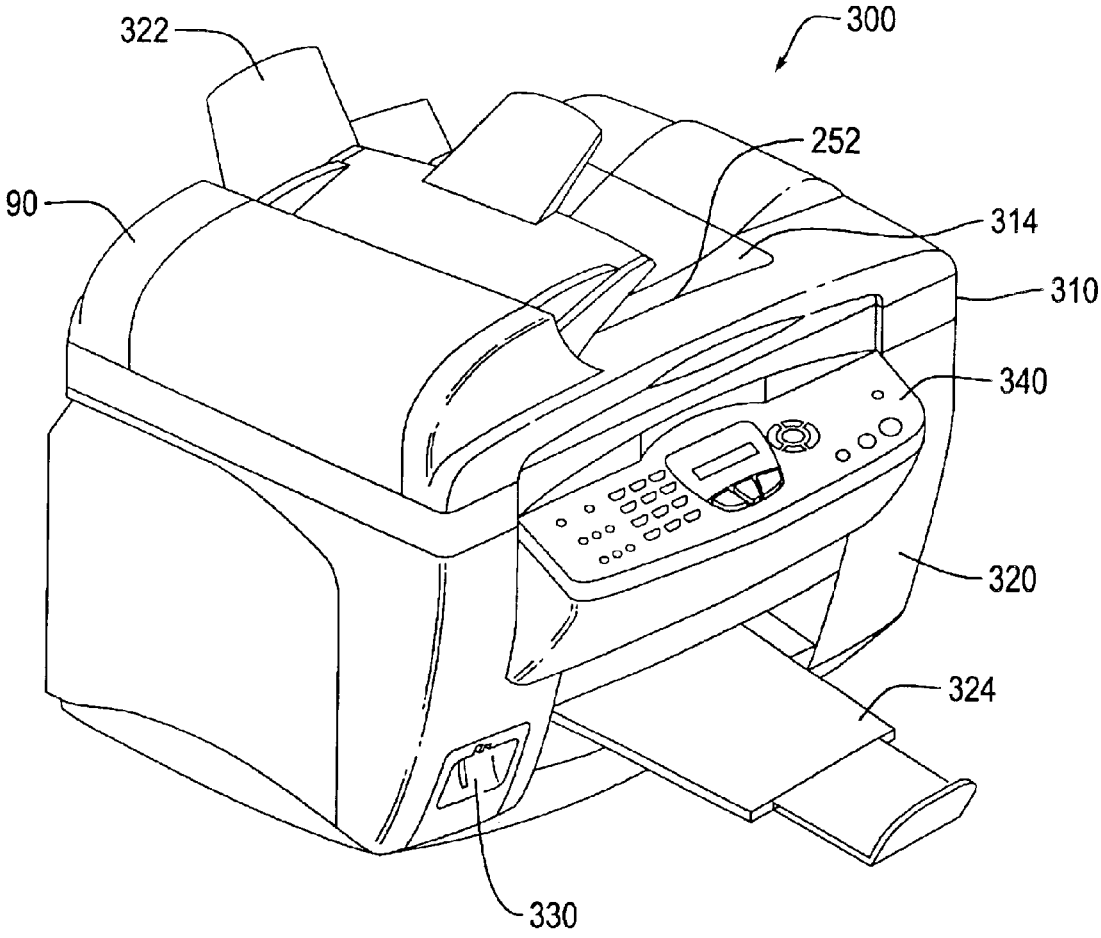
FIG. 26 is a perspective view showing another combined machine of another embodiment as an image formation apparatus of this invention.
Figure 27:
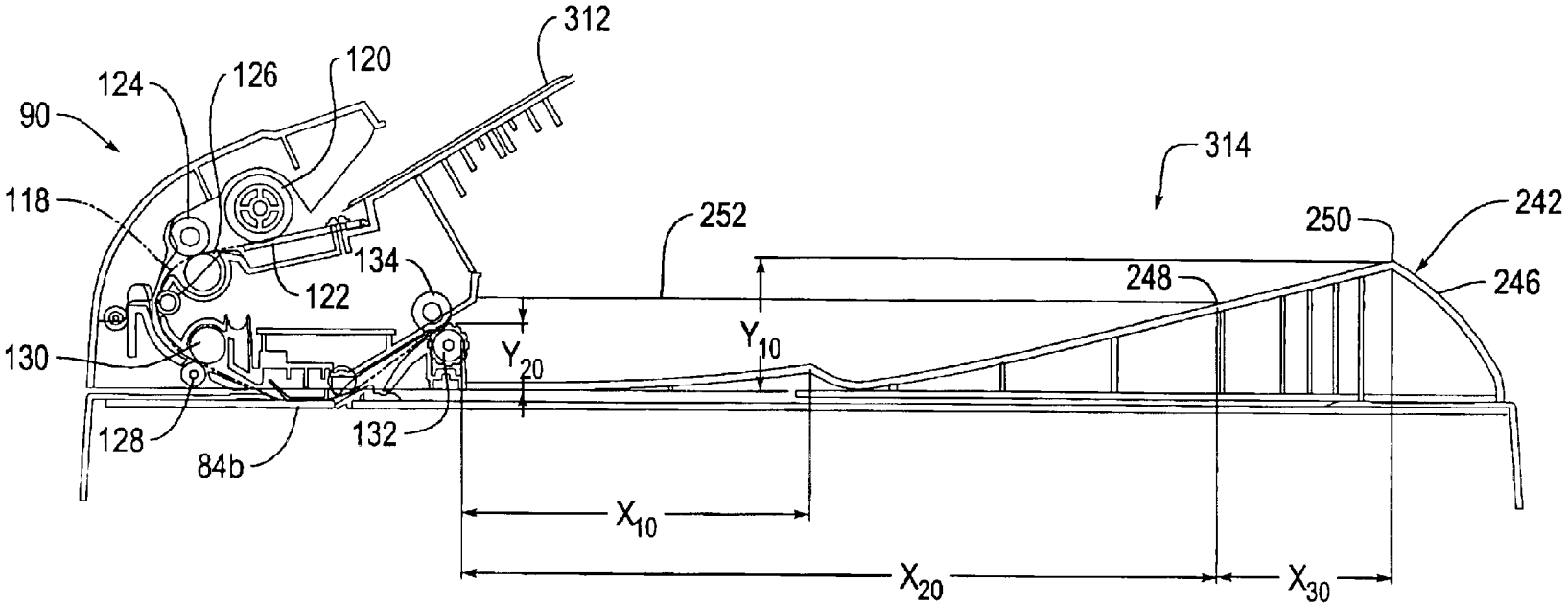
FIG. 27 is a cross-sectional view showing a second embodiment of the automatic document feeder and the discharge tray.
Figure 28:
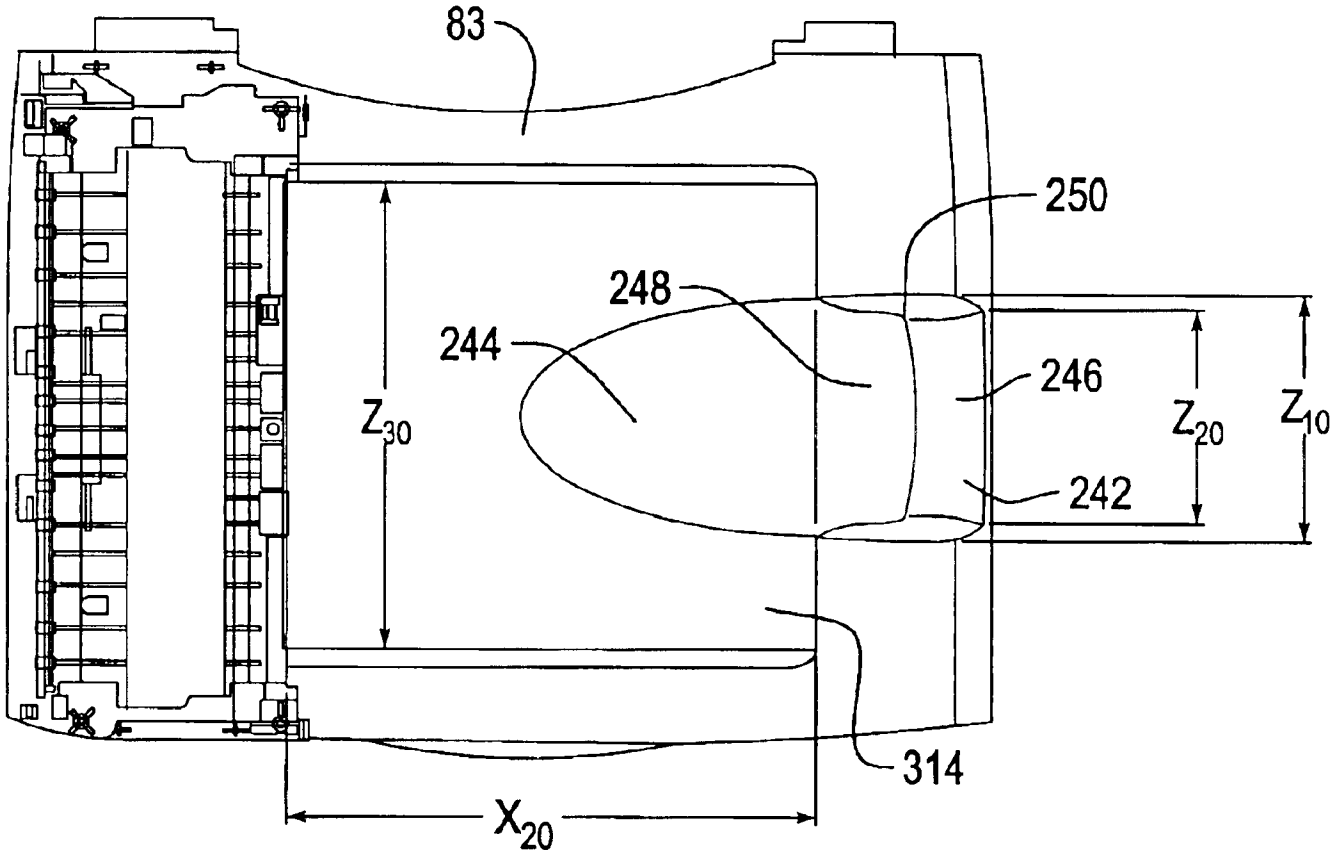
FIG. 28 is a top view showing the second embodiment of the discharge tray.

FIGS. 26–29 illustrate another combined machine in accordance with a second embodiment of the invention. FIGS. 26–28 also illustrate a second discharge tray 314 according to a second embodiment of the invention. As shown in FIG. 26, a combined machine 300 has a facsimile function, a printing function, a copying function and a scanning function. The combined machine 300 includes a scanner body 310 placed on top of a printer body 320, a media slot 330 placed on the lower front surface of the printer body 320 and an operating panel 340 placed on the upper front surface of the printer body 320 and tilted upward at a predetermined angle relative to the front surface. A side, on which the operating panel 320 is provided, is defined as the front of the combined machine 300 and the opposite side is defined as a rear of the combined machine 300. The right and left sides of the combined machine 300 are defined as right and left, respectively, when viewed from the front of the combined machine 300.

Figure 29:
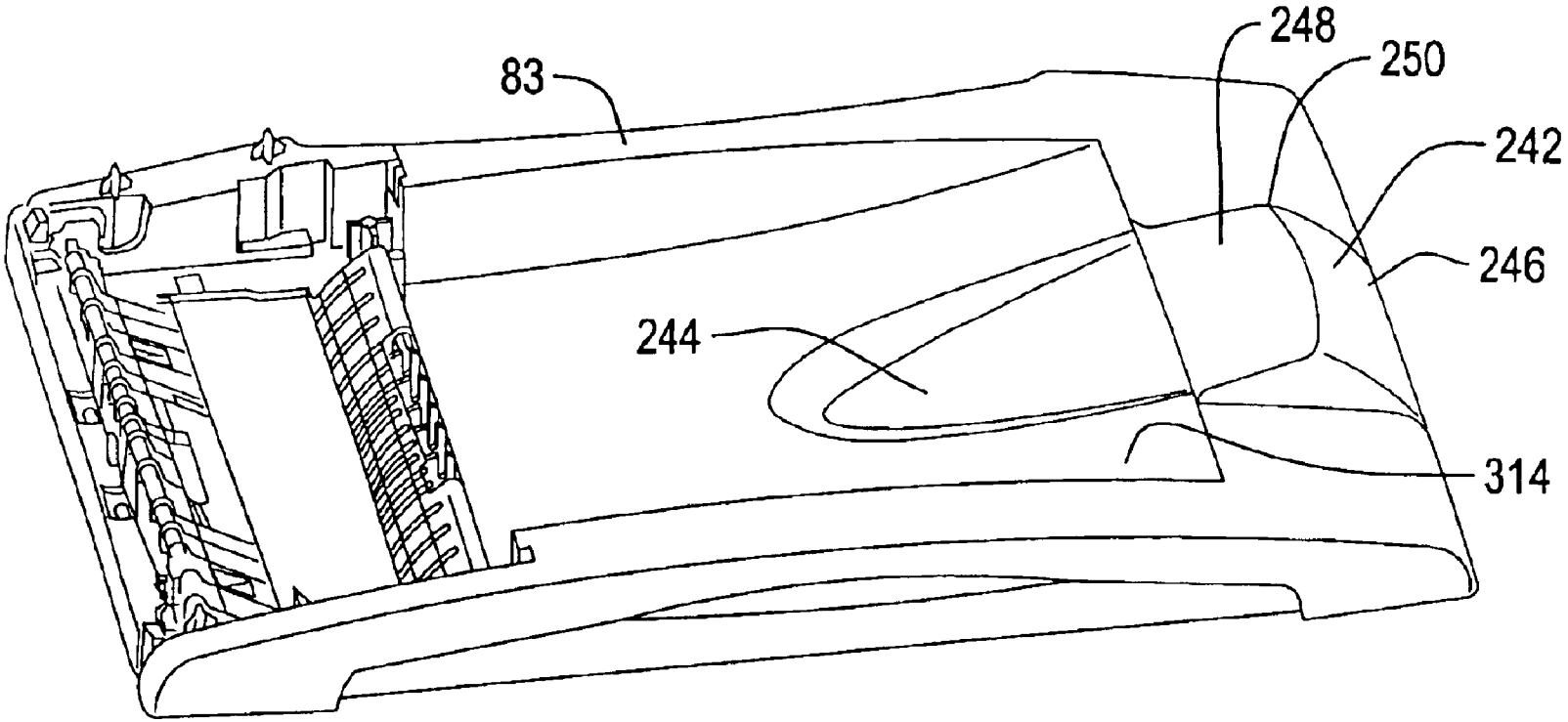
FIG. 29 is a perspective view of the second embodiment of the discharge tray.

The scanner body 310 has a rectangular shaped frame and includes a holding tray 312 provided on the upper left side of the scanner body 310. The holding tray 312 holds original documents, which are to be scanned and transmitted in a facsimile mode or which are to be scanned and reproduced in a copy mode. The original documents placed on the holding tray 312 are conveyed to a scanning unit (not shown) provided in the scanner body 310 using an ADF device 90 and surfaces of the original documents are scanned by the scanning unit. Then, the scanned documents are ejected onto the document pressing cover 83 that includes the discharge tray 314 provided at the right upper side of the scanner body 310. As shown in FIGS. 27–29, the discharge tray 314 includes a projection 242 on the right side of the discharge tray 314 and a recess 244 on the left side of the projection 242. In this embodiment, the projection 242 is formed with the discharge tray 314, unlike the first embodiment.

The printer body 320 has a box shaped frame and includes a supply tray 322, on which a stack of recording sheets are loaded, provided at the rear of the printer body 320. The sheets placed on the supply tray 322 are conveyed, one by one, to a color ink-jet type image forming unit (not shown) provided in the printer body 320. At the image forming unit, predetermined images are printed onto the sheets, and then, the sheets are ejected onto a discharge tray 314. The printer is not limited to the ink-jet type, but can be other types, for example, a laser printing type using toner or a thermal transfer type using an ink ribbon.

Figure 30:
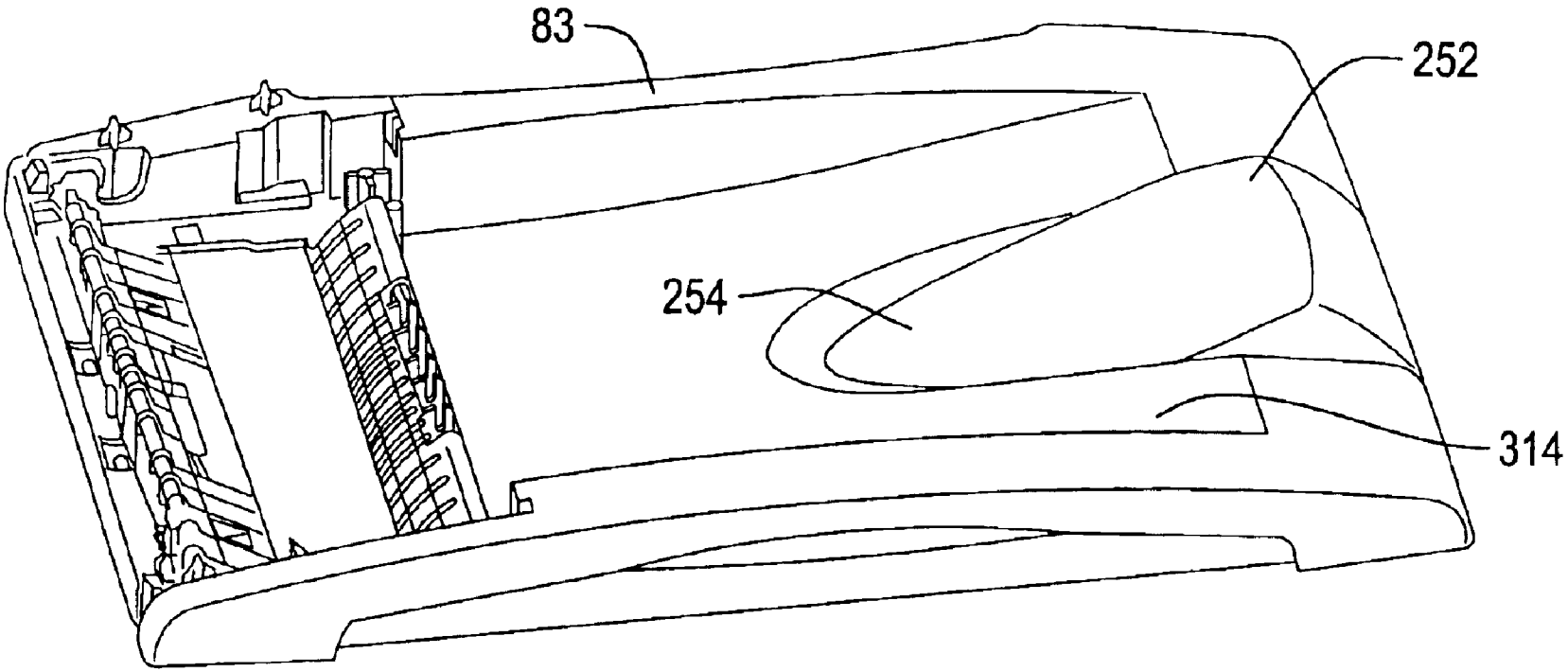
FIG. 30 is a perspective view of a third embodiment of the discharge tray.
Figure 31:
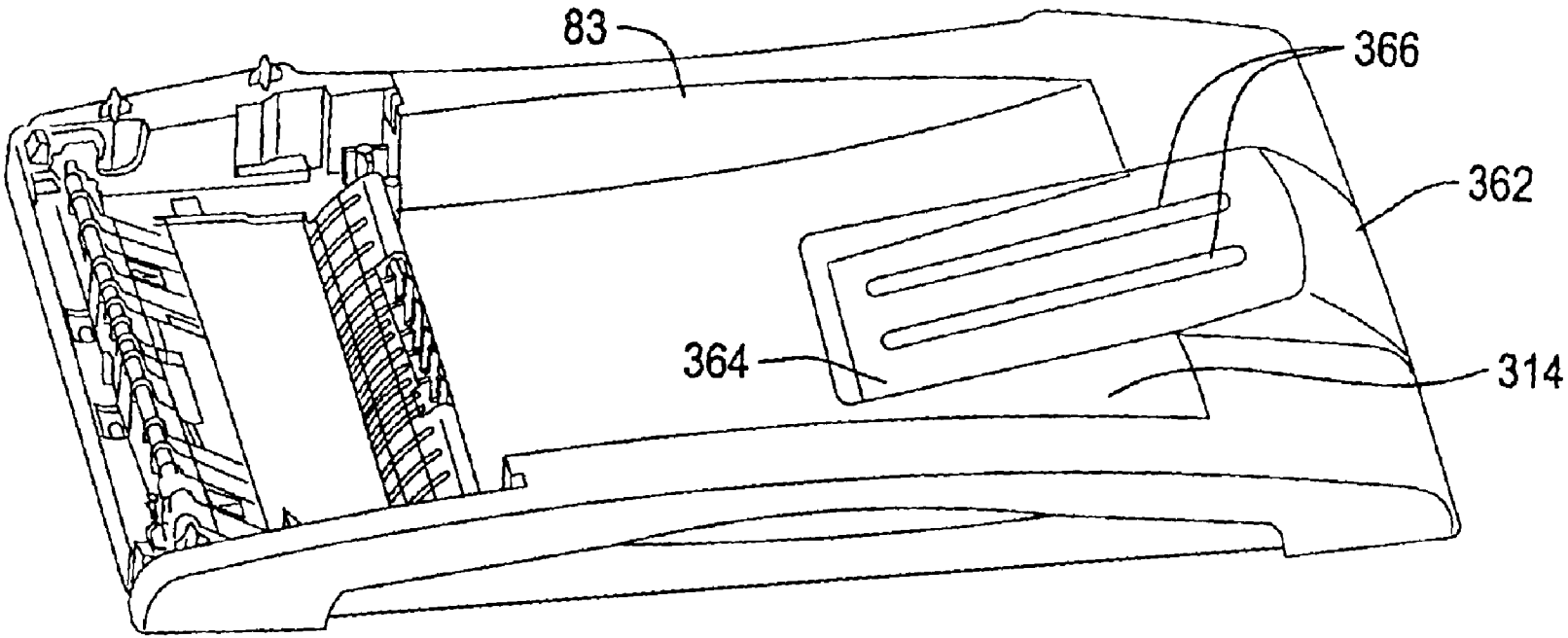
FIG. 31 is a perspective view of a fourth embodiment of the discharge tray.

As shown in FIGS. 28 and 29, the surface of the discharge tray 314 and a front surface of the projection 242 are on the same plane. Thus, stress applied to the leading edge of the discharged documents which are on the projection 242 is reduced. However, as shown in FIGS. 30, the bottom surface of a recess 254 and the front surface of the projection 252 can be on the same plane. A shown in FIG. 31, the bottom surface of the recess 364 and the front surface of the projection 362 can be on the same plane with projections 366 that are long and slim and disposed on the surface of the projection 362 and the recess 364. The projections 366 further simplifies access to discharged documents.

Furthermore, as shown in FIGS. 27–29, the projection 242 has two surfaces 246, 248. The first surface 246 starts from the right end of the projection 242 and slopes upwardly toward a crease 250. The second surface 248 starts from the crease 250 and slopes downwardly toward the left end of the projection 242. As such, the handling of documents is simplified because of the two surfaces 246, 248 which have varying slopes. Also, it is easier to remove discharged documents placed on the projection 242 when the angle between the first surface 246 and the second surface 248 is larger.

In FIGS. 26 and 27, the recess 244 is located on the left side of the projection 242. The recess 244 is not symmetrical as the width of the recess narrows from the right to the left side of the discharge tray 314.

FIG. 27 illustrates the depths of the projection 242 and the recess 244. As shown in FIG. 27, the projection 242 has a height $Y_{10}$ that is higher than the point at which the document is ejected from the ADF device 90, $Y_2$. For example, the projection 242 has a height of 42.5 mm that is higher than the height at which the document is ejected from the ADF device 90, 22.8 mm (these heights are taken from the bottom of the document pressing cover 83). Furthermore, the height of the second surface 248 of the projection 242 gradually decreases to the left of the discharge tray 314. As such, a document that is ejected from the ADF device 90 and placed on the projection 242 is moved to the left side of the discharge tray 140 against the ADF device 90. As such, documents can be easily collected as they are positioned against the ADF device 90. This difference in height ($Y_{10}>Y_{20}$)also allows the projection 242 to act as a stopper.

The height of the recess 244 decreases (i.e., the depth increases) towards the left side of the discharge tray 140 by a height $Y_{30}$. For example, the left side of the recess decreases by a height of 5 mm from a top surface of the discharge tray 314. The height decreases because as the size of the discharged document becomes shorter, the bending of the document becomes smaller. Furthermore, there is less area to grab and remove the document from the discharge tray 314. The increased depth of the recess 244 thus makes it easier to remove shorter documents from the discharge tray 314.

FIG. 28 illustrates the widths of the discharge tray 314, the projection 242 and the recess 244. As shown in FIG. 28, the discharge tray 314 has a width $Z_{30}$ that is larger than the largest width of the documents commonly ejected. For example, the discharge tray 314 has a width of 234 mm which is greater than the width of the letter and legal papers which have a width of 215.9 mm. Thus, the documents are positioned on the discharge tray 314.

The recess 244 has a width that narrows from the right side of the discharge tray 314 to the ADF device 90. Furthermore, the widths of both the projection 242 and the recess 244 are smaller than the widths of documents commonly ejected from the ADF device 90. In FIG. 28, the maximum width $Z_{10}$ of the recess 244 and the projection 242 occurs at the crease 250 of the projection 242. For example the width of the crease 250 is 110 mm which is less than the width of A5 which has the smallest width at 148 mm. Documents that only land on the recess 244 are supported on the front and rear leading edges by the discharge tray 314. As such, documents can easily be removed because the middle leading edge of the document is suspended. Conversely, documents that are placed on the projection 242 are only supported at the middle leading edge of the document. The documents can thus be easily removed because the front and rear leading edges of the document are suspended.

Furthermore, as shown in FIG. 28, the width of the projection 242 decreases from the crease 250, which has a width $Z_{10}$, to the right end of the projection 242 which has a width $Z_{20}$. For example, the projection 242 at the crease 250 has a width of 110 mm while the right end of the projection 242 has a width of 100 mm. Thus, it is easy to remove documents due to the difference in widths.

FIG. 27 illustrates the lengths of the projection 242 and the recess 244 As shown in FIG. 27, the distance between the point at which the document is ejected from the ADF device 90 to the left end of the recess 244 is indicated as $X_{10}$. $X_{10}$ is smaller than the length of the shortest document commonly ejected from the ADF device 90. For example $X_{10}$ has a length of 110 mm which is smaller than the length of the shortest commonly ejected document A5 which has a length of 148 mm. As such, the leading edge of the shortest document commonly ejected from the ADF 90 overlaps at least a portion of the recess 244 so that the document can be easily removed.

$X_{10}$ is also longer than the length between the rollers in the ADF device 90. For example, the length between document supply roller 120 and resist roller 124 is 20.5 mm, the length between the resist roller 124 and the resist roller 126 is 47.5 mm, the length between the resist roller 128 and ADF document reading position 84*b* is 39 mm and the length between the ADF document reading position 84*b* and the discharge roller 132 is 49.3 mm, all of which are less than the length of 110 mm for $X_{10}$. With this example, the shortest paper length that the ADF device feeds is 88.3 mm. Documents are thus easily supplied by the ADF device 90.

The distance between the point at which the document is ejected from the ADF device 90 to the leading edge of the projection 242 is indicated as $X_{20}$. As should be appreciated, the leading edge of the projection 242 is not at the same height at which the documents are ejected from the ADF device 90. A rising edge of the projection 242 is equal to the edge 252 of the discharge tray 314. $X_{20}$ is longer than the length of the shortest document commonly ejected from the ADF device 90 but shorter than the longest document commonly ejected from the ADF device 90. For example, $X_{20}$ has a length of 242 mm which is longer than the length of A5 which has a length of 148 mm but shorter than legal paper which has a length of 355.6 mm. At least two documents of two different lengths can thus be placed and removed at two different positions on the discharge tray 140. Also, $X_{20}$ is not equal to the length of documents commonly ejected from the ADF device 90. This prevent the edge of the discharged document from corresponding with a leading edge of the projection 242. In other words, the leading and trailing edges of the document are not both supported by the ADF device 90 and the ejected documents are also easier to collect when this length is not the same because the documents can slide toward the ADF device 90.

Also, the distance between the leading edge of the projection 242 and the crease 250 is indicated as $X_{30}$. The combined length of $X_{20}$ and $X_{30}$ is longer than the length of a medium sized document commonly ejected from the ADF device 90 but shorter than the longest document commonly ejected from the ADF device 90. For example, $X_{20}$ and $X_{30}$ have a combined length of 288 mm which is longer than the length of letter sized paper which has a middle length of 279.4 mm but is shorter than legal paper which has a length of 355.6 mm.

As should be appreciated, the width of the projection 242 at the crease 250 has a width $Z_{10}$. This width is shorter than the width of documents commonly ejected that have a length greater than the sum of $X_{20}$ and $X_{30}$. In this example, legal paper with a length of 355.6 mm and A4 paper with a length of 297 mm have a length greater than 288 mm. As such, the leading edges of these documents that are placed beyond the crease 250 of the projection 242 can be retrieved from the front, middle and rear leading edges.

While the invention has been described in detailed with reference to the specific embodiments thereof, it should be apparent to those skilled in the art the various changes, arrangements in modifications may apply therein without departing from the spirit and scope of the invention.

What is claimed is:

1. A tray, comprising:

a surface with a first end and a second end opposite to the first end;

a projection extending away from the surface and from the second end of the surface, wherein the projection is formed integrally with the surface as a one-piece member; and a recess formed within the surface and from the projection toward the first end, wherein the tray is a discharge tray located at a downstream side of a feeding device that feeds documents.

2. The tray of claim 1, wherein when a first document is placed on the surface the first document extends from the first end and covers only a portion of the recess and when a second document is placed on the surface, the second document having a length longer than the first document, the second document extends from the first end and covers all of the recess and only a portion of the projection.

3. The tray of claim 1, wherein the first end is connected to a feeding device that feeds documents.

4. The tray of claim 1, wherein the projection extends from the surface such that the projection has a height that is higher than a discharge point at which the documents are discharged from the feeding device.

5. The tray of claim 1, wherein a distance between a discharge point at which the documents are discharged from the feeding device and an end of the recess located on the first end side is shorter than a length of the documents discharged onto the surface.

6. The tray of claim 1, wherein the distance between a discharge point at which the documents are discharged from the feeding device and an end of the projection located on the first end side is not equal to a length of the documents discharged onto the surface.

7. The tray of claim 1, wherein the projection has a first surface extending from the second end to a crease formed along the width of the projection and a second surface extending from the crease to an end of the projection located on the first end side, with the first surface and the second surface extending from the crease toward the surface.

8. The tray of claim 7, wherein the surface and the second surface of the projection are on a same plane.

9. The tray of claim 7, wherein the second surface of the projection and the recess are on a same plane.

10. The tray of claim 9, wherein at least one second projection extends from the projection to the recess.

11. The tray of claim 1, wherein the recess is not symmetrical.

12. The tray of claim 11, wherein a width of the recess decreases with proximity to the first end.

13. The tray of claim 1, wherein a width of both the projection and the recess is shorter than the width of documents discharged onto the surface.

14. The tray of claim 1, wherein a depth of the recess formed below the surface increases with proximity to the first end.

15. An image formation apparatus, comprising:

an image forming apparatus in which an image can be formed on a recording medium;

an image reading device that reads an image recorded on the document; and the tray of claim 1 which receives the document after the image recorded on the document has been read by the image reading device.

16. A tray, comprising a surface with a first end and a second end opposite to the first end;

a projection extending away from the surface and from the second end of the surface, wherein the projection is formed integrally with the surface as a one-piece member; and a recess formed below the surface and from the projection toward the first end, wherein the tray is a document setting tray located at an upstream side of a feeding device that feeds documents.

17. A method of scanning documents in an image formation apparatus, comprising:

feeding documents to a scanner one by one;

scanning the fed document;

discharging the scanned document to a discharge tray with a surface with a first end and a second end opposite to the first end, a projection extending away from the surface and from the second end of the surface, wherein the projection is formed integrally with the surface as a one-piece member, and a recess formed within the surface and extending from the projection toward the first end.

18. The method of claim 17, wherein when a first document is placed on the surface, the first document extends from the first end and covers only a portion of the recess and when a second document is placed on the surface, the second document having a length longer than the first document, the second document extends from the first end and covers all of the recess and only a portion of the projection.

* * * * *